US008453278B2

(12) United States Patent
Aiken et al.

(10) Patent No.: US 8,453,278 B2
(45) Date of Patent: Jun. 4, 2013

(54) INFANT SUPPORT STRUCTURE WITH ACCESSIBILITY FEATURE

(75) Inventors: Brian Aiken, East Aurora, NY (US); Mark Weppner, Williamsville, NY (US)

(73) Assignee: Mattel, Inc., El Segundo, CA (US)

( * ) Notice: Subject to any disclaimer, the term of this patent is extended or adjusted under 35 U.S.C. 154(b) by 1073 days.

(21) Appl. No.: 12/350,377

(22) Filed: Jan. 8, 2009

(65) Prior Publication Data

US 2010/0000016 A1 Jan. 7, 2010

Related U.S. Application Data

(60) Provisional application No. 61/036,141, filed on Mar. 13, 2008, provisional application No. 61/021,093, filed on Jan. 15, 2008.

(51) Int. Cl.
*A47D 7/03* (2006.01)

(52) U.S. Cl.
USPC ..... 5/100; 5/97; 5/93.1

(58) Field of Classification Search
USPC ..... 5/93.1, 97, 100; 256/25, 26, 73
See application file for complete search history.

(56) References Cited

U.S. PATENT DOCUMENTS

| | | | | |
|---|---|---|---|---|
| 836,326 | A | | 11/1906 | Kinyon |
| 949,389 | A | | 2/1910 | Almgren |
| 1,211,762 | A | | 1/1917 | Sawyer |
| 2,267,176 | A | | 12/1941 | Turner |
| 2,412,005 | A | | 12/1946 | Parsons |
| 2,477,231 | A | * | 7/1949 | Bourdon ..... 5/93.1 |
| 2,486,466 | A | | 11/1949 | Davis |
| 2,533,983 | A | | 12/1950 | Weigle et al. |
| 2,555,160 | A | * | 5/1951 | Schwarz ..... 5/93.1 |
| 2,632,186 | A | * | 3/1953 | Berk ..... 5/99.1 |
| 3,403,412 | A | * | 10/1968 | Gottfried et al. ..... 5/100 |
| 3,659,297 | A | | 5/1972 | Schutz |
| D231,874 | S | | 6/1974 | Weigel et al. |
| 4,146,885 | A | | 3/1979 | Lawson, Jr. |
| 4,231,127 | A | | 11/1980 | Bendell |
| 4,525,883 | A | * | 7/1985 | Necowitz ..... 5/93.2 |
| 4,706,312 | A | | 11/1987 | Shamie |
| 4,712,773 | A | * | 12/1987 | Larson ..... 256/25 |
| 4,715,075 | A | | 12/1987 | Shamie |
| 4,811,436 | A | | 3/1989 | Schwartz |
| 4,959,787 | A | | 9/1990 | Morishita et al. |
| 5,054,138 | A | | 10/1991 | Wesley |
| 5,359,740 | A | | 11/1994 | Markley et al. |
| 5,381,571 | A | | 1/1995 | Gabhart |

(Continued)

FOREIGN PATENT DOCUMENTS

GB 2267822 B 12/1993

OTHER PUBLICATIONS

International Search Report for PCT/US2009/030531 dated Apr. 3, 2009, 8 pages.
Two product photographs from May 2008 and Summary Statement, 3 pages.

*Primary Examiner* — William Kelleher
(74) *Attorney, Agent, or Firm* — Edell, Shapiro & Finnan, LLC

(57) ABSTRACT

The present invention relates to an infant support structure. In particular, the present invention relates to an infant support structure with a movable portion that facilitates access to a particular area or portion of the infant support structure.

10 Claims, 28 Drawing Sheets

U.S. PATENT DOCUMENTS

| | | | | |
|---|---|---|---|---|
| 5,416,934 | A | 5/1995 | Bracken et al. | |
| 5,491,851 | A | 2/1996 | Alonso | |
| 5,884,348 | A | 3/1999 | Onishi et al. | |
| 5,926,870 | A | 7/1999 | Branca-Barnes et al. | |
| 6,618,877 | B2 | 9/2003 | Stephen | |
| 6,848,129 | B1 | 2/2005 | Amato et al. | |
| 6,938,286 | B1 * | 9/2005 | Smith | 5/100 |
| D594,245 | S * | 6/2009 | Hagstrom et al. | D6/390 |
| 7,540,046 | B1 * | 6/2009 | Lai | 5/100 |
| 2006/0218727 | A1 | 10/2006 | Jones | |

* cited by examiner

INFANT SUPPORT STRUCTURE WITH ACCESSIBILITY FEATURE

CROSS-REFERENCE TO RELATED APPLICATIONS

This application claims priority to U.S. Provisional Patent Application Ser. No. 61/021,093, entitled "Infant Support Structure with Accessibility Feature," filed Jan. 15, 2008, and priority to U.S. Provisional Patent Application Ser. No. 61/036,141, entitled "Infant Support Structure with Accessibility Feature," filed Mar. 13, 2008, the disclosure of each of which is incorporated herein by reference in its entirety.

FIELD OF THE INVENTION

The present invention relates to an infant support structure. In particular, the present invention relates to an infant support structure with a movable portion that facilitates access to a particular area or portion of the infant support structure.

BACKGROUND OF THE INVENTION

There are many types of infant support structures. Infant support structures usually include a frame and an area or region in which an infant or child may be placed. Depending on the configuration of the frame, access to the area or region in which an infant may be placed can be difficult.

For example, infant support structures such as a crib or a playard typically include a frame that has sides defining an infant receiving area. While the sides of the infant support structure may be a certain height for safety purposes, the height of the sides can sometimes make placing an infant into or removing an infant from the infant receiving area difficult for some parents or caregivers. In addition, some infant support structures may include a mattress or pad on which the infant can rest and be placed. The height of the sides may make removing or inserting the mattress or pad difficult for some users as well.

Therefore, a need exists for an infant support structure with an adjustable frame that includes a part or component that can be moved to improve the access to an infant receiving area.

SUMMARY OF THE INVENTION

The present invention relates to an infant support structure that has a frame that defines an infant receiving area. In one embodiment, the frame of the infant support structure includes a part or portion that is movable relative to the other parts of the frame. The movable part of the frame can be manipulated by a parent or caregiver so that the infant receiving area can be accessed. In one embodiment, the frame includes two parts that are movable relative to the frame. Each of the movable parts is configured to be retained in a closed or locking position relative to the frame. In one embodiment, the movable part or parts can be locked in their closed positions. In one embodiment, the movable part or parts can be configured to cooperate with each other and engage each other to be locked in their closed positions. Each movable part can be moved along a first direction and along a second direction. In one embodiment, movement along the first direction may be to unlock the movable part and movement along the second direction may be to open the side by moving the movable part outwardly. In another embodiment, one movable part may include a locking mechanism and another movable part may include its own locking mechanism. The locking mechanism is configured to retain the respective movable part in a closed position relative to the frame.

BRIEF DESCRIPTION OF THE DRAWINGS

Like reference numerals have been used to identify like elements throughout this disclosure.

DETAILED DESCRIPTION OF THE INVENTION

The present invention relates to an infant support structure that has a frame that defines an infant receiving area. In one embodiment, the frame of the infant support structure includes a part or portion that is movable relative to the other parts of the frame. The movable part of the frame can be manipulated by a parent or caregiver so that the infant receiving area can be accessed. In one embodiment, the frame includes two parts that are movable relative to the frame. Each of the movable parts is configured to be retained in a closed or locking position relative to the frame.

The term "infant support structure" is used to refer to any type of structure that can be used to support an infant or child. Some exemplary infant support structures include cribs, bassinets, and playards. The terms "infant" and "child" may be used interchangeably herein. The terms "latch mechanism" and "locking mechanism" may be used interchangeable herein and are used to refer to any type of mechanism or structure that can be used to secure or retain a movable member or object in place.

Figure 1:
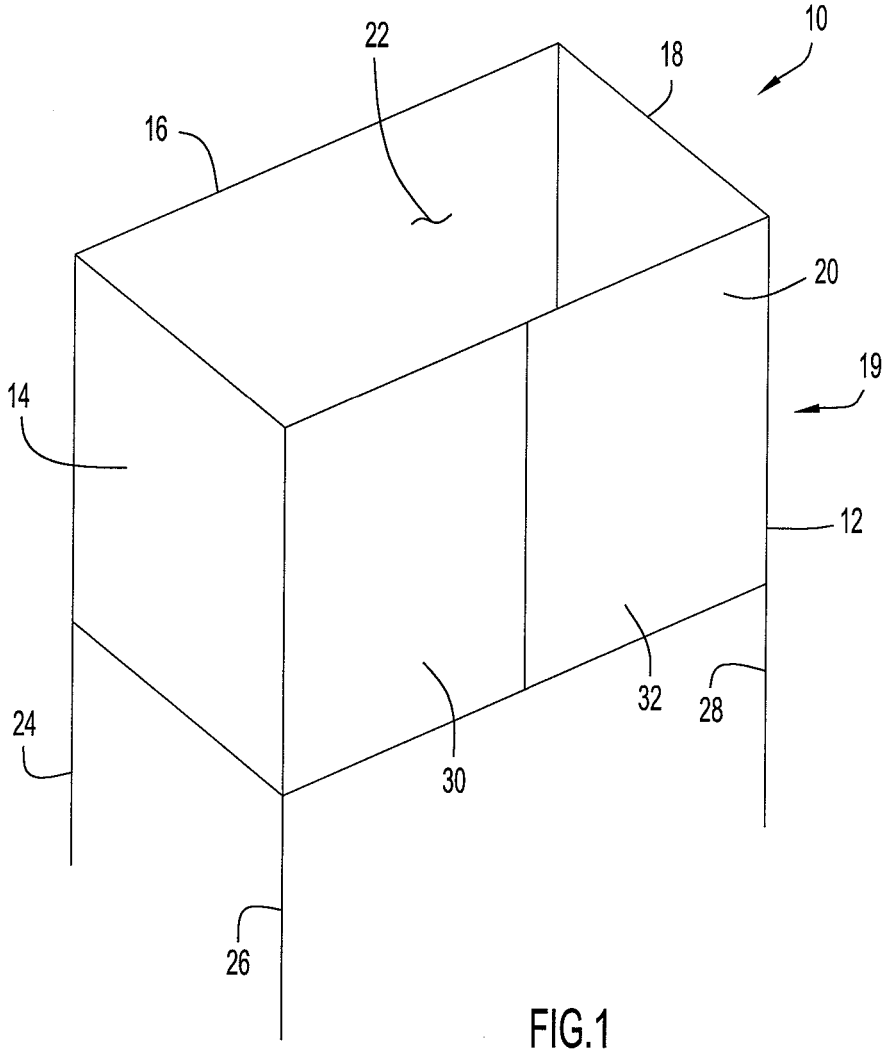
FIG. 1 illustrates a schematic perspective view of an embodiment of an infant support structure according to an aspect of the present invention.

A schematic view of an embodiment of an infant support structure is illustrated in FIG. 1. In this embodiment, the infant support structure 10 includes a frame 12 that has several sides 14, 16, 18, and 20 that form an upper portion 17 of the frame 12. The sides 14, 16, 18, and 20 collectively form an enclosure that defines an area 22 in which an infant can be placed. Area 22 can be referred to alternatively as an "infant receiving area" or an "infant receiving region." The frame 12 includes several legs 24, 26, and 28, with the fourth leg not illustrated in FIG. 1. The legs and platform form a lower portion of the frame 12 and are configured to support the frame 12 on a support surface such as a floor.

While the frame 12 is illustrated as having four sides 14, 16, 18, and 20, each of which are substantially planar, in alternative embodiments, the frame many have any number of sides and each of the sides may have different configurations or shapes. In addition, some of the sides may be referred to as ends depending on the frame and/or configuration.

In this embodiment, one of the sides of the frame 12, in particular side 20, includes two side portions 30 and 32. The side portions can be referred to alternatively as "doors," "gates," "gate portions," "movable parts," or "movable portions." The side portions 30 and 32 are movably mounted to the frame 12 so that each of the side portions 30 and 32 can move relative to the other parts of the frame 12.

Figure 2:
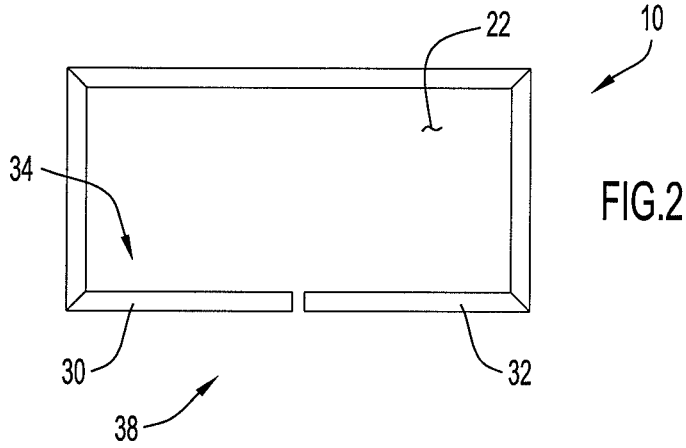
FIG. 2 illustrates a top view of the infant support structure illustrated in FIG. 1 in a closed configuration.
Figure 3:
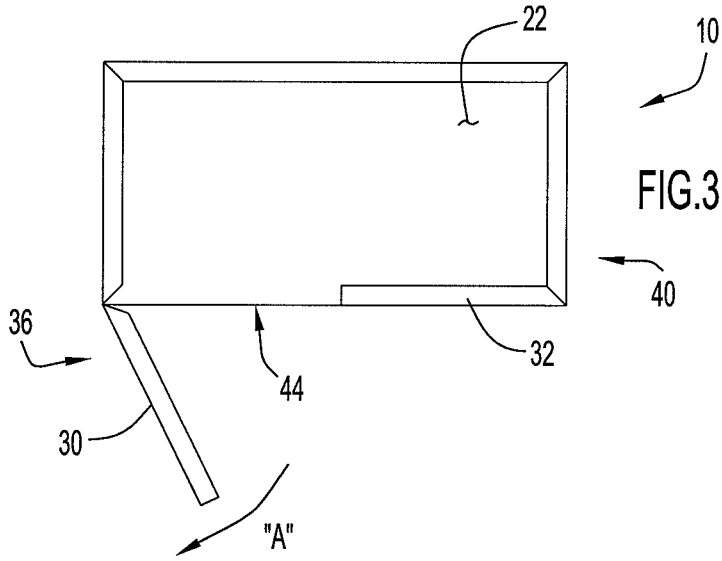
FIG. 3 illustrates a top view of the infant support structure illustrated in FIG. 1 in a partially open configuration.
Figure 4:
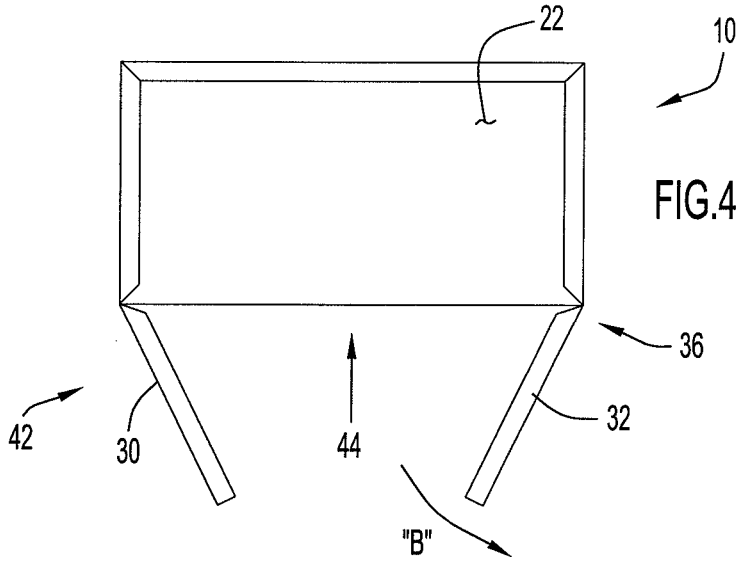
FIG. 4 illustrates a top view of the infant support structure illustrated in FIG. 1 in an open configuration.

Referring to FIGS. 2-4, various movements of the side portions 30 and 32 are illustrated. As shown, the infant support structure 10 includes an infant receiving region 22. Referring to FIG. 2, the side portions 30 and 32 are illustrated in their closed positions 34. The sides of the frame 12 form an enclosure that defines the infant receiving region 22. When the side portions 30 and 32 are in their closed positions 34, the side portions 30 and 32 collectively have a closed configuration 38 and a parent cannot access the infant receiving area 22 through a side of the frame 12. The parent would have to reach over the side portions 30 and 32.

Referring to FIG. 3, side portion 30 of the infant support structure 10 is illustrated as having been moved along the direction of arrow "A" to an open position 36. When the side portion 30 is rotated or pivoted to its open position 36, a passageway or opening 44 is formed in the frame by the outward movement of the side portion 30. The range of motion of the side portion 30 can vary. The side portion 30 can be disposed or positioned in a variety of positions relative to the frame 12. The relative size of opening 44 depends on the positions of the side portions 30 and 32. In FIG. 3, side portion 32 is in its closed position, which creates a partially open or partially closed configuration 40.

Referring to FIG. 4, side portion 32 is moved along the direction of arrow "B" to an open position 36. In their open positions, the side portions 30 and 32 collectively form an open configuration 42 and define a relatively large opening 44 through which a parent or caregiver can easily access the infant receiving area 22 of the infant support structure 10. The size of the opening 44 is larger in configuration 42 than in configuration 40.

Figure 2A:
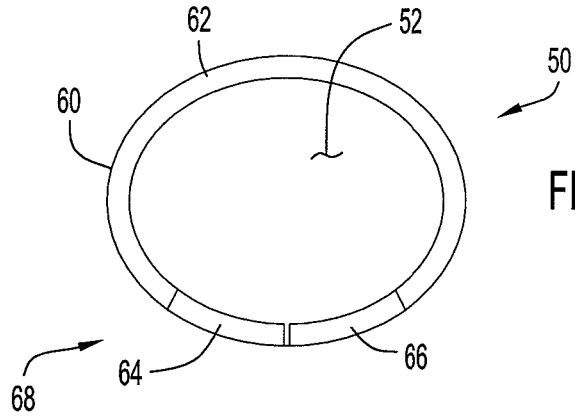
FIG. 2A illustrates a top view of an alternative embodiment of an infant support structure in a closed configuration according to an aspect of the present invention.
Figure 3A:
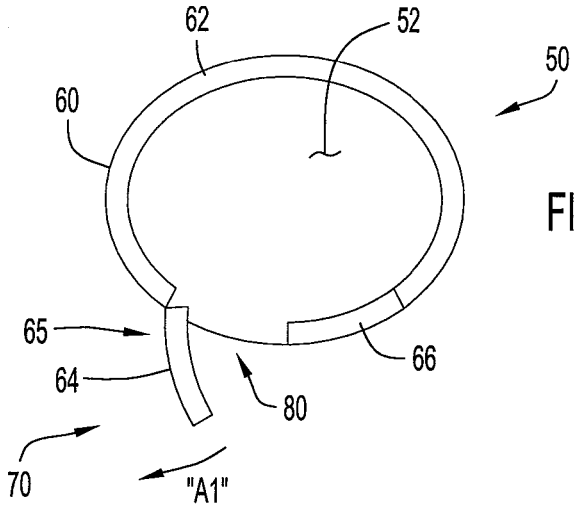
FIG. 3A illustrates a top view of the infant support structure illustrated in FIG. 2A in a partially open configuration.
Figure 4A:
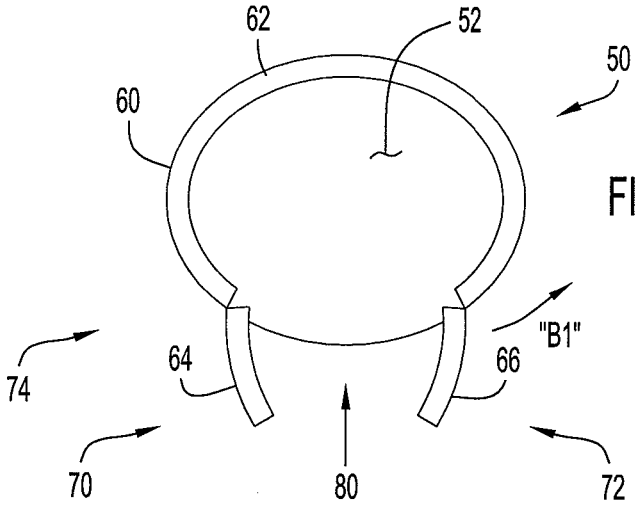
FIG. 4A illustrates a top view of the infant support structure illustrated in FIG. 2A in an open configuration.

An alternative embodiment of an infant support structure according to the present invention is illustrated in FIGS. 2A, 3A, and 4A. The infant support structure 50 includes a frame 60 that has several side portions 62, 64, and 66 that collectively extend along the perimeter of the frame 60 and define an infant receiving region 52 therebetween. In this embodiment, side portion 62 is a main portion and side portions 64 and 66 are pivotally coupled to the frame 60. In one embodiment, the side portions 64 and 66 can be pivotally coupled to the main portion 62. In FIG. 2A, the side portions 64 and 66 are illustrated in their closed positions and with side portion 62, they collectively have a closed configuration 68. In this embodiment, frame 60 has a generally curved or substantially circular configuration.

Referring to FIG. 3A, side portion 64 of the infant support structure 50 is illustrated as having been moved along the direction of arrow "A1" to an open position 65. When the side portion 64 is rotated or pivoted to its open position 65, a passageway or opening 80 is formed in the frame 60 by the outward movement of the side portion 64. The range of motion of the side portion 64 can vary. The side portion 64 can be disposed or positioned in a variety of positions relative to the frame 60. The relative size of opening 80 depends on the positions of the side portions 64 and 66. In FIG. 3A, side portion 66 is in its closed position, which creates a partially open or partially closed configuration 70.

Referring to FIG. 4A, side portion 66 is moved along the direction of arrow "B1" to an open position 72. In their open positions, the side portions 64 and 66 collectively form an open configuration 74 and define a relatively large opening 80 through which a parent or caregiver can easily access the infant receiving area 52 of the infant support structure 50. The size of the opening 80 is larger in configuration 74 than in configuration 70.

Figure 5:
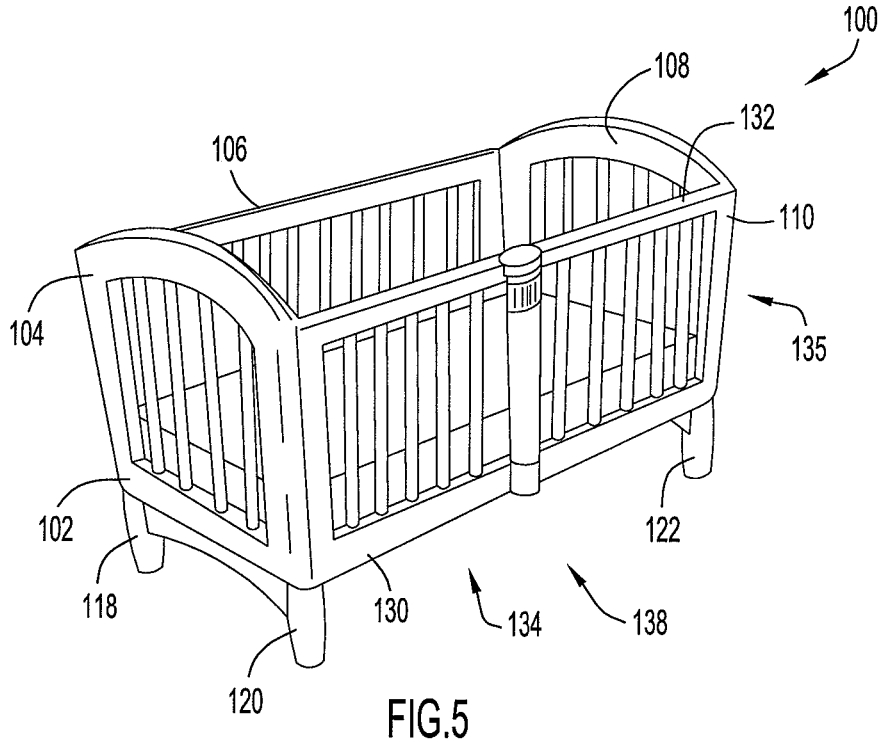
FIG. 5 illustrates a perspective view of an alternative embodiment of an infant support structure according to an aspect of the present invention.
Figure 6:
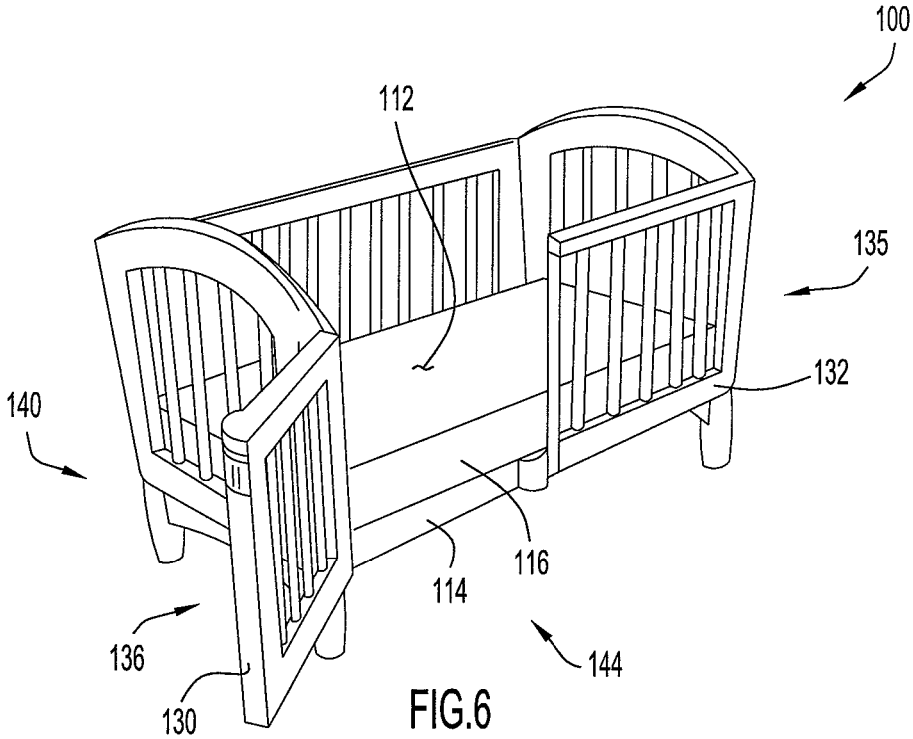
FIG. 6 illustrates a perspective view of the infant support structure illustrated in FIG. 5 in a partially open configuration.
Figure 7:
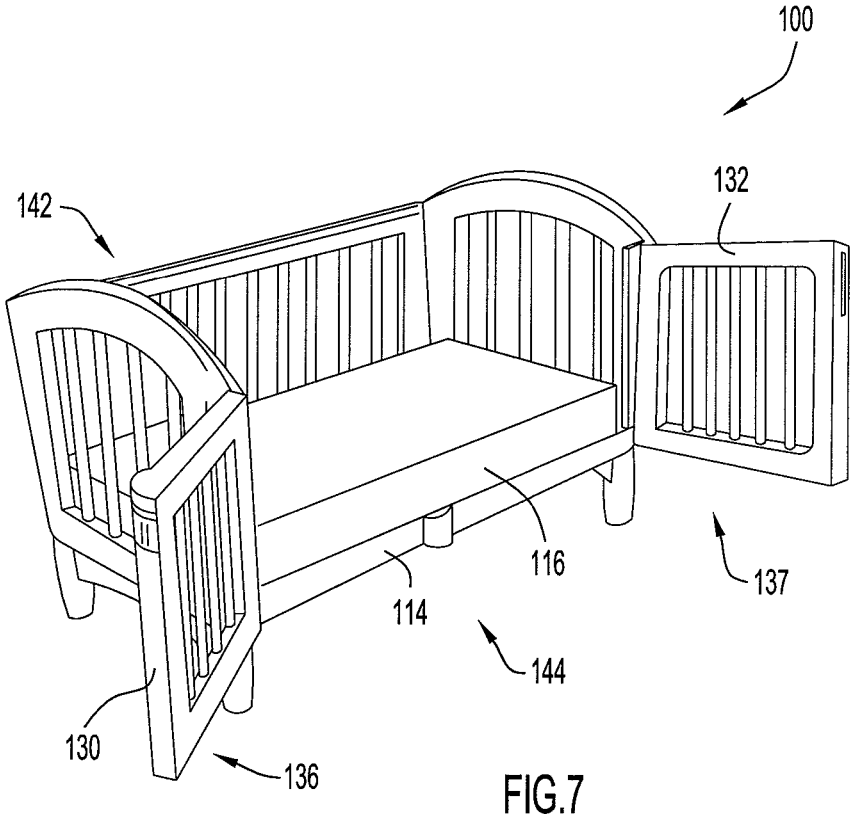
FIG. 7 illustrates a perspective view of the infant support structure illustrated in FIG. 5 in an open configuration.

An alternative embodiment of an infant support structure according to the present invention is illustrated in FIGS. 5-7. The infant support structure 100 includes a frame 102 with sides 104, 106, 108, and 110, which collectively define an infant receiving area 112 (see FIG. 6). As shown in FIGS. 6 and 7, the frame 102 includes a lower portion 114 on which a mattress or other support 116 can be placed. In this embodiment, the infant support structure 100 is a crib that includes four legs (only legs 118, 120, and 122 are illustrated) that are configured to engage a support surface.

Referring to FIG. 5, side 110 includes two side portions 130 and 132 that are movably mounted to the frame 102. The side portions 130 and 132 are illustrated in their closed positions 134 and 135, respectively, in FIG. 5. When the side portions 130 and 132 are in their closed positions, the infant support structure 100 is in its closed configuration 138 and the frame 102 provides a closed and safe support around its perimeter.

Referring to FIG. 6, side portion 130 is illustrated as being in an open position 136 while side portion 132 is illustrated as remaining in its closed position 135. In this arrangement, the side portions 130 and 132 collectively form a partially open or partially closed configuration 140. When side portion 130 is in its open position 136, an opening or passageway 144 is provided to allow a parent or caregiver access to the infant receiving area 112.

Referring to FIG. 7, side portion 132 is illustrated as being in an open position 137. When side portions 130 and 132 are moved to their open positions 136 and 137, respectively, the infant support structure 100 is in an open or fully open configuration 142. The side portions 130 and 132 can be moved so that a parent or caregiver has full access to the infant receiving area 112 of the infant support structure 100. In this configuration, the mattress or support 116 can be easily slid out of the receiving area 112 through passageway 144. Alternatively, the parent can easily reach a child in area 112.

Figure 8:
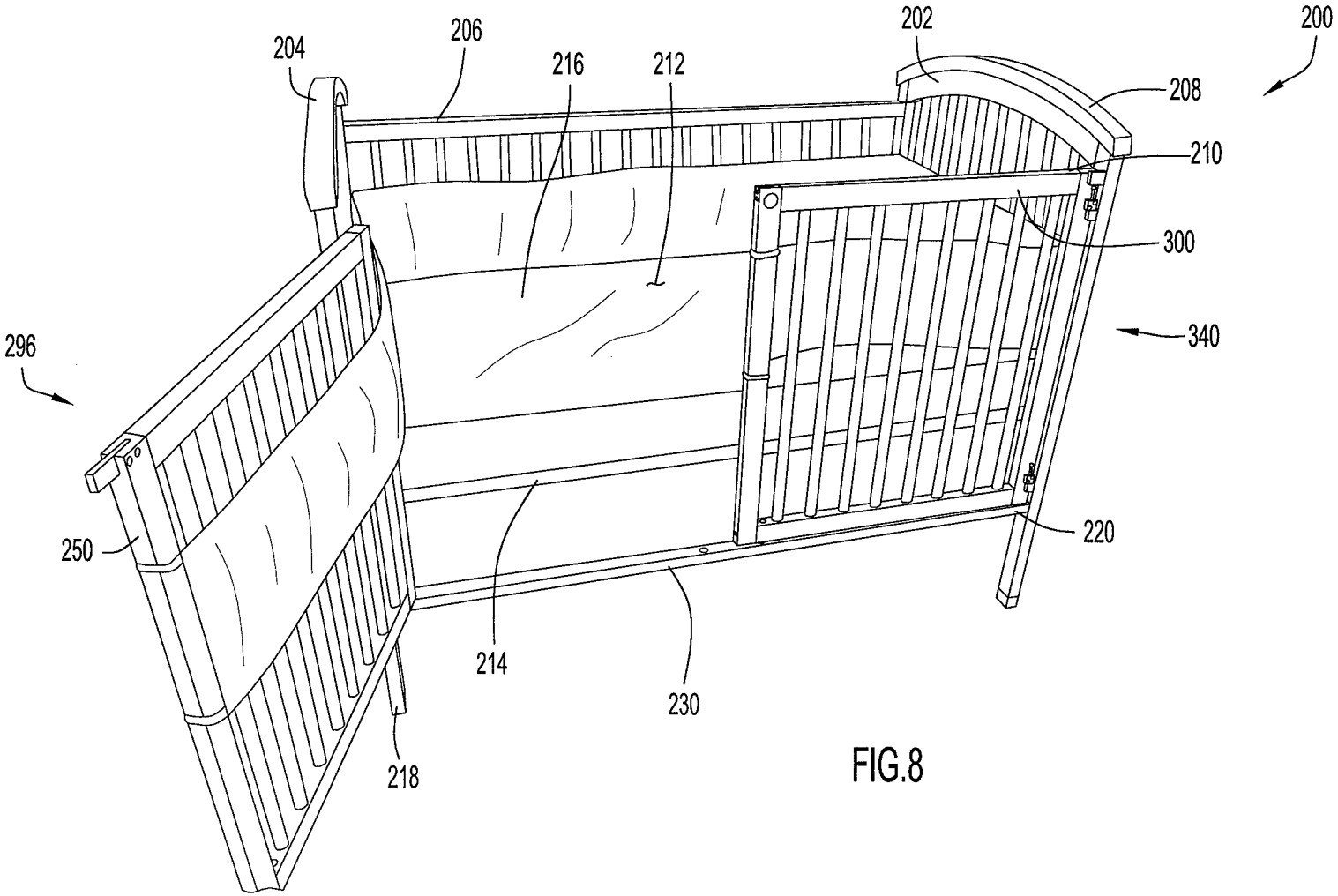
FIG. 8 illustrates a front view of an alternative embodiment of an infant support structure in a partially open configuration according to an aspect of the present invention.
Figure 9:
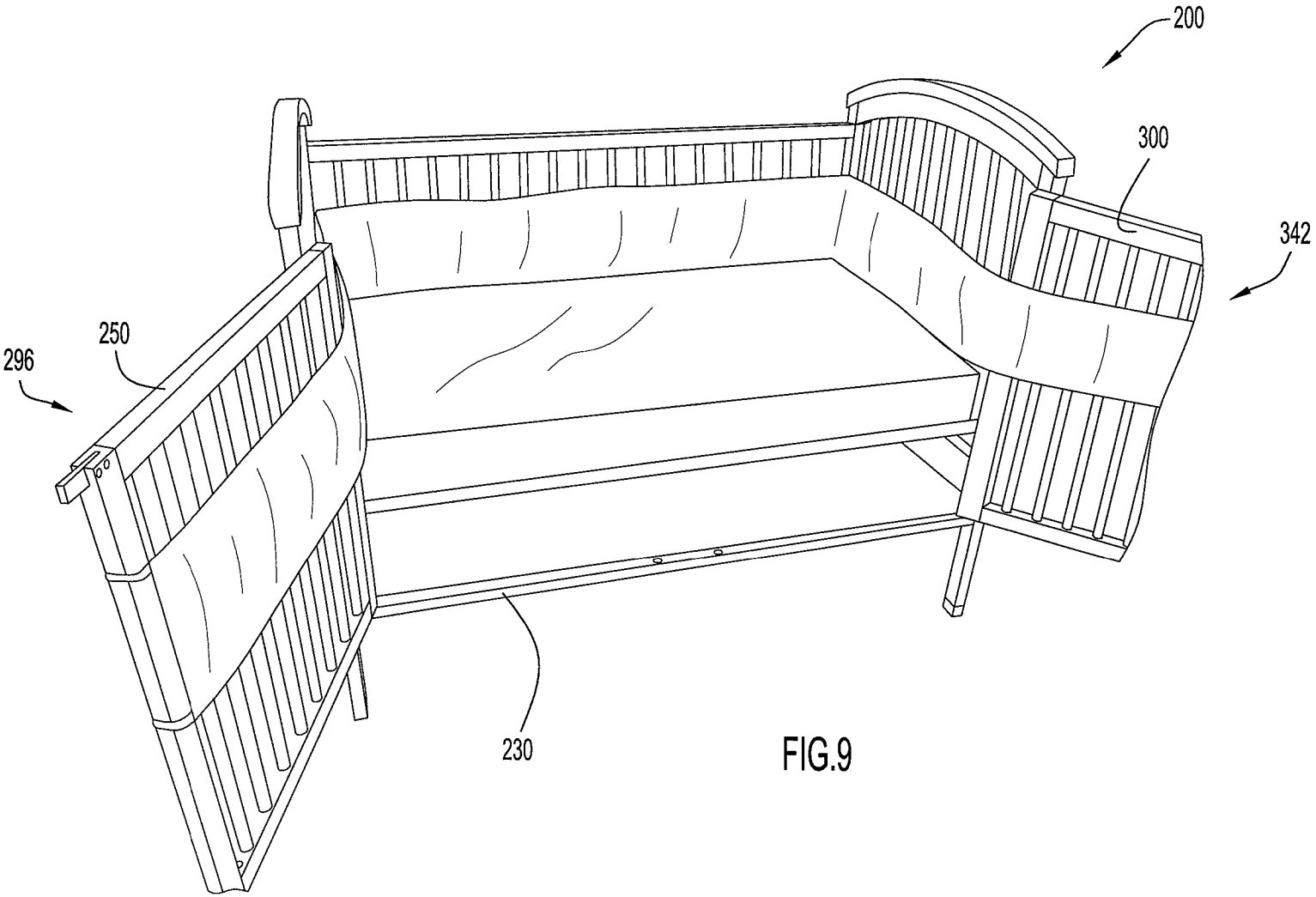
FIG. 9 illustrates a front view of the infant support structure illustrated in FIG. 8 in an open configuration.

An alternative embodiment of an infant support structure is illustrated in FIGS. 8 and 9. Infant support structure 200 includes a frame 202 that has sides 204, 206, 208, and 210 that collectively define an infant receiving area 212. The frame 202 includes a lower support 214 on which a mattress 216 or other support structure can be placed. Only two legs (legs 218 and 220) of the four legs for the frame 202 are illustrated in FIG. 8.

Side 210 includes two door or side portions 250 and 300 that are movably supported by the frame 202. Each of the side portions 250 and 300 is movable between a closed position and a fully open position. The side portions 250 and 300 can also be placed in any number of intermediate open positions. Some of the positions are shown in FIGS. 8 and 9. In FIG. 8, side portion 250 is in its open position 296 and side portion 300 is in its closed position 340. In FIG. 9, side portion 250 is in its open position 296 and side portion 300 is in its open position 342. The side portions 250 and 300 can be rotated or pivoted outwardly from their closed positions to their open positions.

When the side portions 250 and 300 are in their closed positions, the side portions 250 and 300 are secured relative to the frame 202. The terms "secured," "locked," and "latched" may be used interchangeably herein to refer to the arrangement in which the side portions are not movable along a particular direction relative to the frame 202. As shown in FIG. 8, the frame 202 includes a latch member or bar 230 that extends along side 210 of the infant support structure 200. As will be described in greater detail below, each of the side portions 250 and 300 is configured to engage the latch member 230 so that the particular side portion is retained in its closed position. When a parent wants to access area 212, the parent disengages side portion 250 from the latch member 230, thereby rendering it movable. Also, as described below, the side portions 250 and 300 are configured to cooperate or engage each other.

Figure 10:
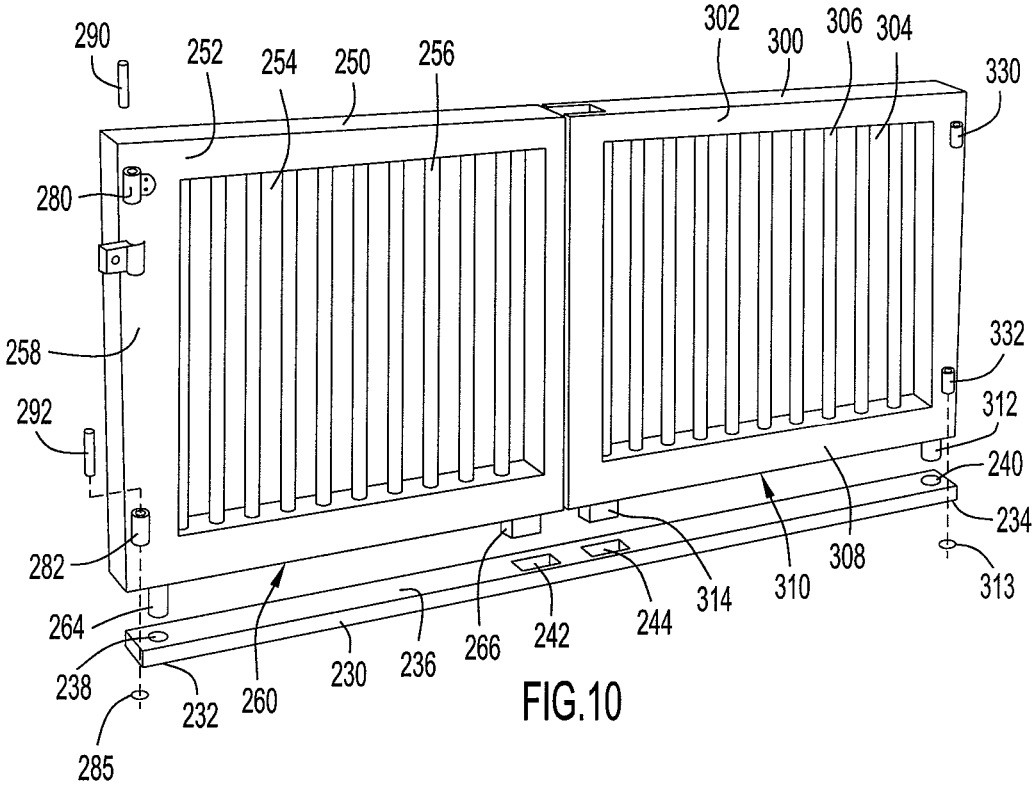
FIG. 10 illustrates a perspective view of the side portions of the infant support structure illustrated in FIG. 8 in a closed configuration.

Referring to FIG. 10, the latch member 230 is illustrated. In this embodiment, latch member 230 is an elongate member with ends 232 and 234. The latch member 230 has an upper surface 236 in which holes 238, 240, 242, and 244 are formed. The sizes, configurations and locations of the holes can vary in different embodiments. The holes can be referred to alternatively as "notches," "recesses," and "slots." As described below, holes 238 and 242 are associated with side portion 250 and holes 240 and 244 are associated with side portion 300.

Figure 11:
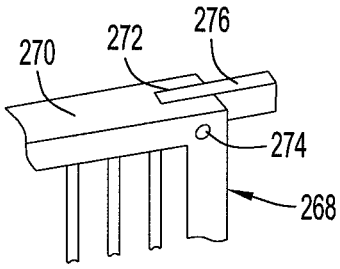
FIG. 11 illustrates a close-up perspective view of part of one of the side portions of the infant support structure illustrated in FIG. 10.
Figure 12:
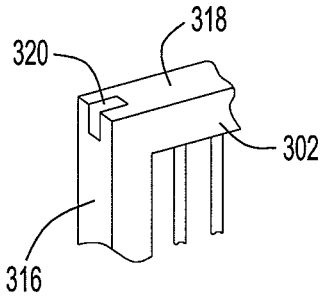
FIG. 12 illustrates a close-up perspective view of part of one of the side portions of the infant support structure illustrated in FIG. 10.

Referring to FIGS. 10-12, the side portions 250 and 300 are illustrated relative to each other and the latch member 230. In this embodiment, side portion 250 includes a frame 252 that extends around the perimeter of the side portion 250. The frame 252 defines an opening 254 in which several bars or elongate members 256 are disposed or placed. The frame 252 has an outer surface 258 that is oriented toward the outside of the infant support structure 200. The frame 252 also includes a lower surface 260.

As shown in FIG. 10, side portion 250 includes a projection 264 that extends from the lower surface 260 of the frame 252. Side portion 250 also includes another projection 266 that extends from the lower surface 260. The projections 264 and 266 are configured to engage recesses 238 and 242, respectively. When the projections 264 and 266 engage the recesses 238 and 242, the side portion 250 cannot move laterally or outwardly relative to the latch member 230.

In one embodiment, the projection 264 can be a substantially cylindrical object that is inserted into a corresponding hole formed in the lower surface 260 of the frame 252. In alternative embodiments, the projection can vary in size and shape and the manner in which it is coupled to the side portion 250.

Coupled to the frame 252 are mounting components 280 and 282 which are used to movably mount the side portion 250 to the frame 202. The mounting components 280 and 282 are configured to receive connectors 290 and 292, such as pins, which define the axis 285 about which the side portion 250 pivots.

Side portion 300 includes a frame 302 that extends around the perimeter of the side portion 300. The frame 302 defines an opening 304 in which several bars or elongate members 306 are disposed or placed. The frame 302 has an outer surface 308 that is oriented toward the outside of the infant support structure 200. The frame 302 also includes a lower surface 310.

Similar to side portion 250, side portion 300 includes projections 312 and 314 that extend from the lower surface 310 of the frame 302. The projections 312 and 314 are configured to engage recesses 240 and 244, respectively, formed in latch member 230. When the projections 312 and 314 engage the recesses 240 and 244, side portion 300 does not move laterally relative to the latch member 230 and frame 202. Coupled to the frame 302 are mounting components 330 and 332 which are used to movably mount the side portion 300 to the frame 202 of the infant support structure 200. The mounting components 330 and 332 are configured to receive connectors, such as pins, which define the axis 313 about which the side portion 300 pivots.

In other embodiments, each of the side portions may include a single projection that extends from the frame of the side portion. Also, the size and configuration of the projections can vary in different embodiments.

The side portions 250 and 300 include cooperating locking structures that are configured to engage each other. Referring to FIG. 11, a part of side portion 250 is illustrated. Side portion 250 includes a side surface 268 and an upper surface 270. A notch or slot 272 is formed in the side surface 268 and upper surface 270. A locking member or extension 276 is configured to be inserted into the slot 272. In one embodiment, the side portion 250 is made of wood and the locking member 276 is made of metal. A hole 274 is formed in the side portion frame 252 and configured to receive a connector, such as a screw or bolt, to secure the locking member 276 in the slot 272.

Referring to FIG. 12, a part of side portion 300 is illustrated. The frame 302 of side portion 300 includes a side surface 316 and an upper surface 318. A slot 320 is formed in the side surface 316 and the upper surface 318. The slot 320 is configured to receive a portion of the locking member 276 that extends outwardly from the side surface 268 of the frame 252 of the side portion 250. When the locking member 276 engages the slot 320 on side portion 300, the side portions 250 and 300 are not permitted to rotate relative to each other.

To open the side 210 of the infant support structure 200 and move the side portions 250 and 300 relative to each other, side portion 250 must be disengaged and unlocked from side portion 300. Side portion 250 is movable between a lower position and an upper position relative to the frame 202. Similarly, side portion 300 is movable between a lower position and an upper position relative to the frame 202. The upward and downward movements are substantially linear in nature.

Figure 13:
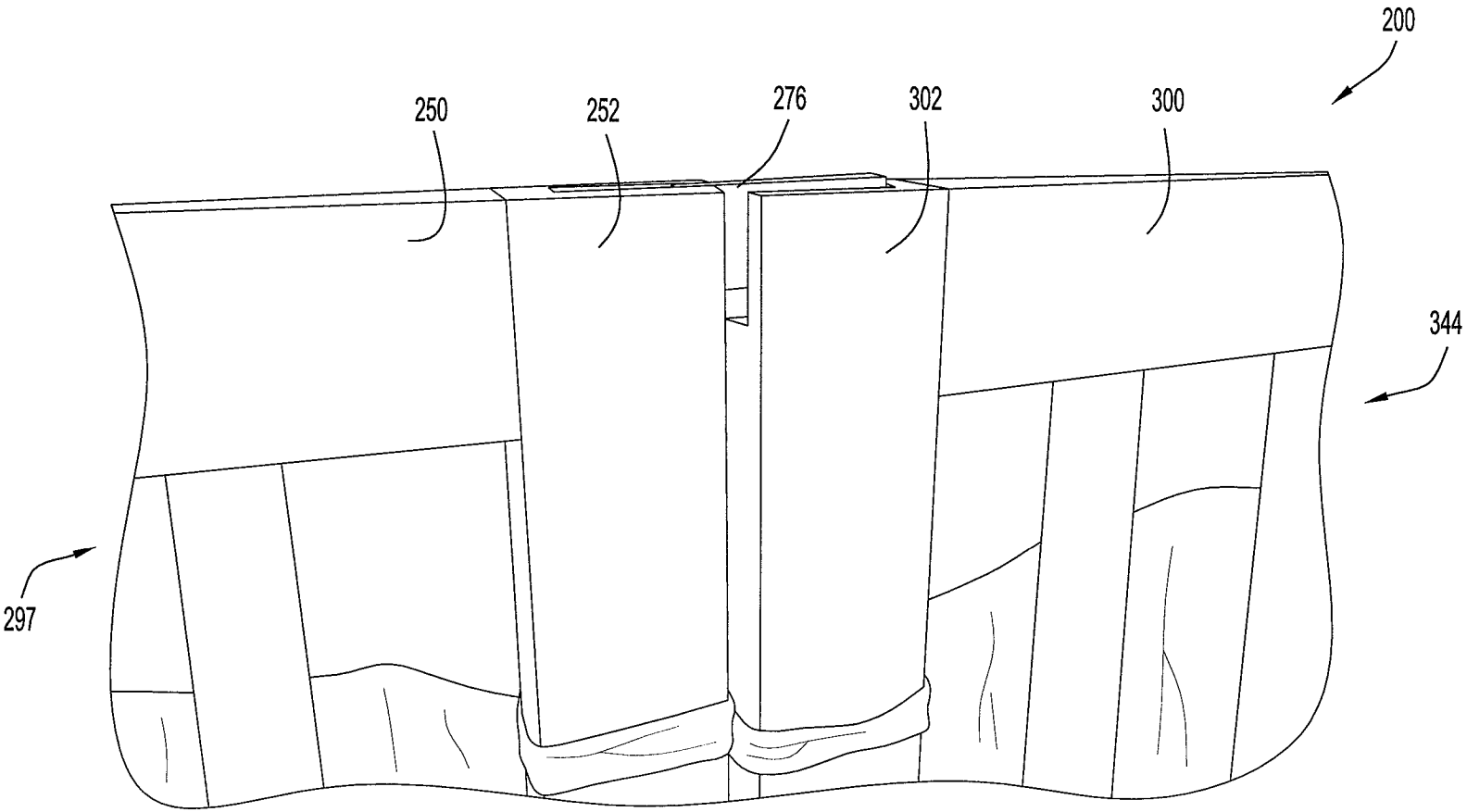
FIG. 13 illustrates a front view of the upper parts of the side portions of the infant support structure illustrated in FIG. 8 in a locked configuration.
Figure 14:
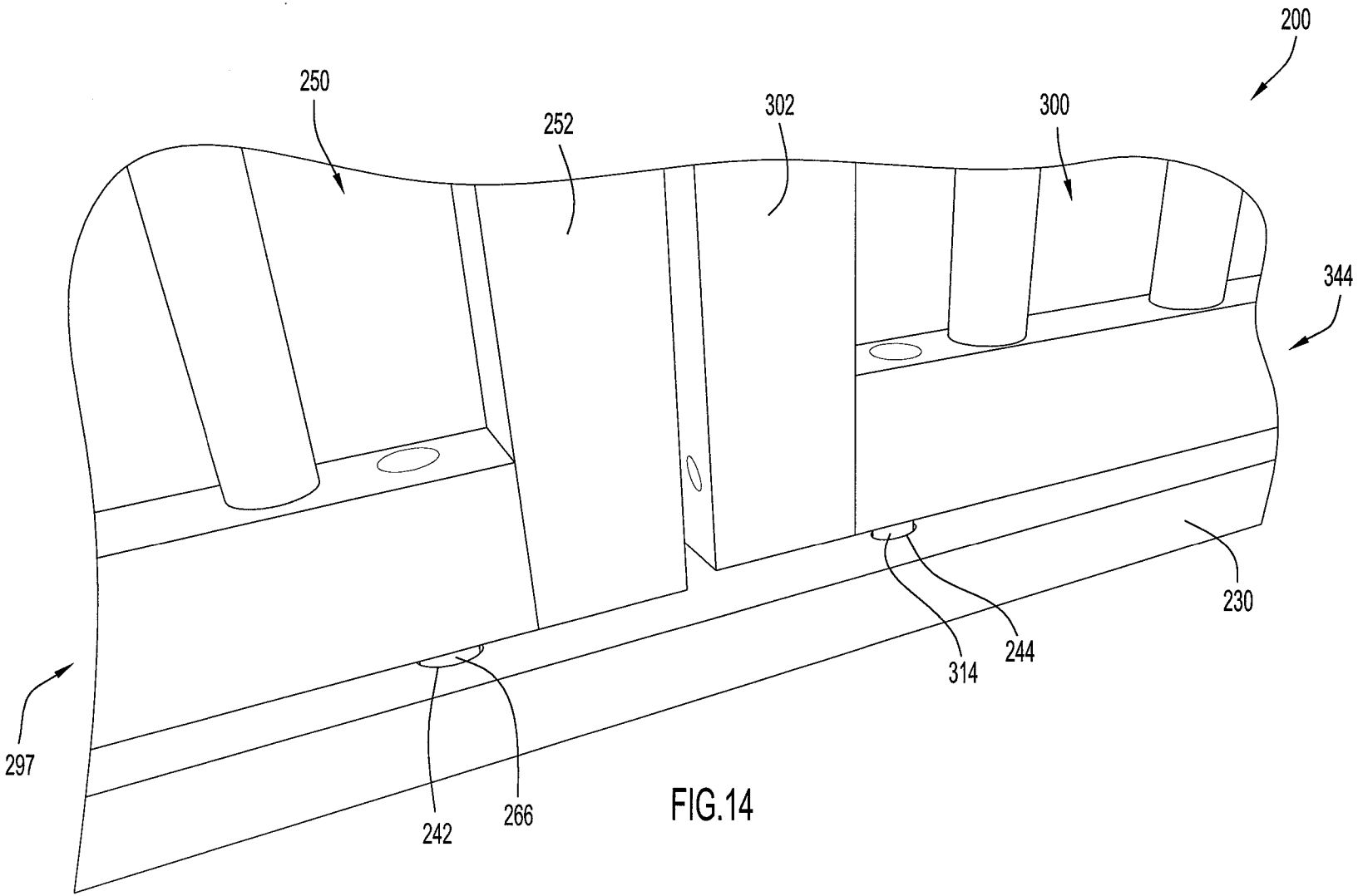
FIG. 14 illustrates a front view of the lower parts of the side portions illustrated in FIG. 13.

Referring to FIGS. 13 and 14, each of the side portions 250 and 300 is illustrated in its lower position. Side portion 250 is illustrated in its lower position 297 and side portion 300 is illustrated in its lower position 344. As shown in FIG. 13, in these positions, locking member 276 extends from frame 252 and is inserted into the slot formed in the frame 302. As shown in FIG. 14, projection 266 on side portion 250 engages hole 242 in latch member 230 and projection 314 on side portion 300 engages hole 244 in latch member 230. Thus, when the side portions 250 and 300 are in their lower positions 297 and 344, respectively, the side portions 250 and 300 are retained in their closed positions and cannot be pushed or rotated outwardly.

Figure 15:
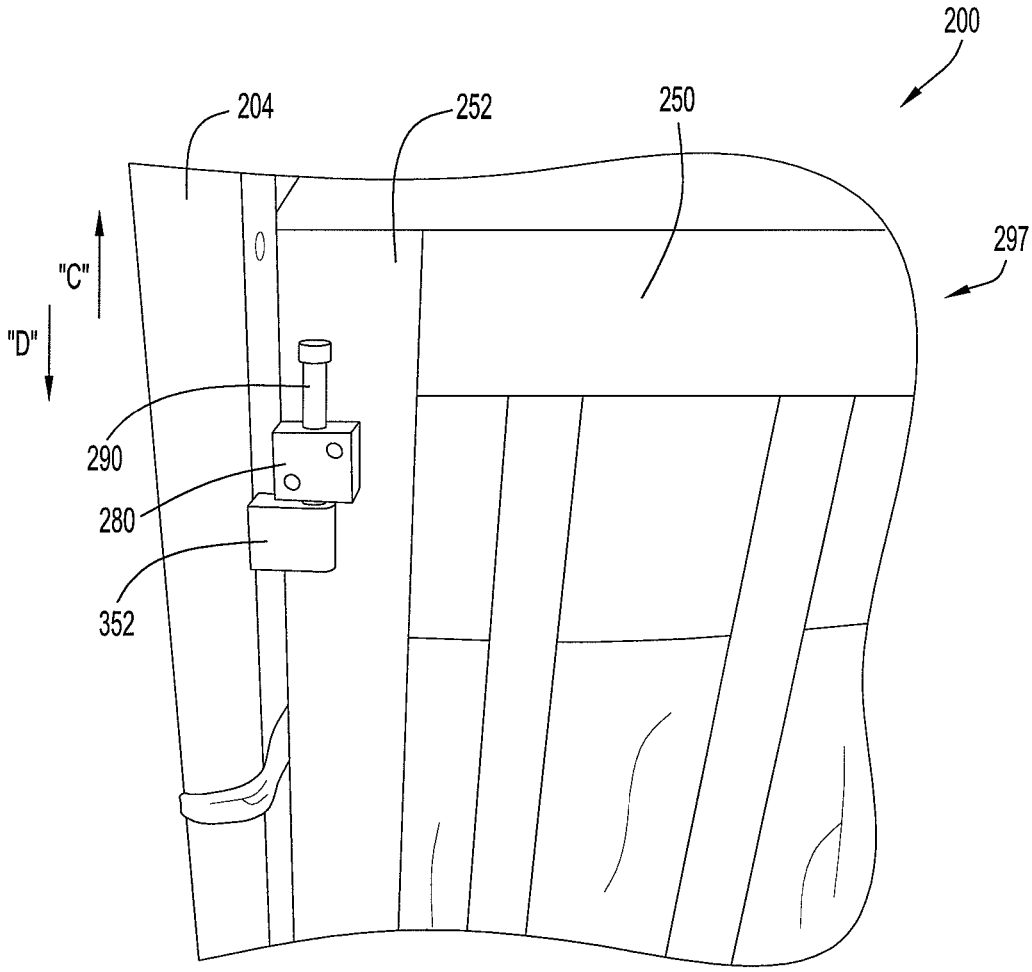
FIG. 15 illustrates a front view of a portion of the frame of the infant support structure illustrated in FIG. 8.

Referring to FIG. 15, the mounting of the side portion 250 to the frame 202 of the infant support structure 200 is illustrated. In particular, the side portion 250 is mounted to side 204 of the frame 202. The side portion frame 252 is illustrated in its lower position 297. A coupler 280 is connected to the outer surface of the side portion 250 using conventional fasteners, such as screws. Another coupler 352 is connected to side 204 of frame 202. Connector 290 is configured to be inserted through a hole in coupler 280 and into a hole formed in coupler 352.

Figure 16:
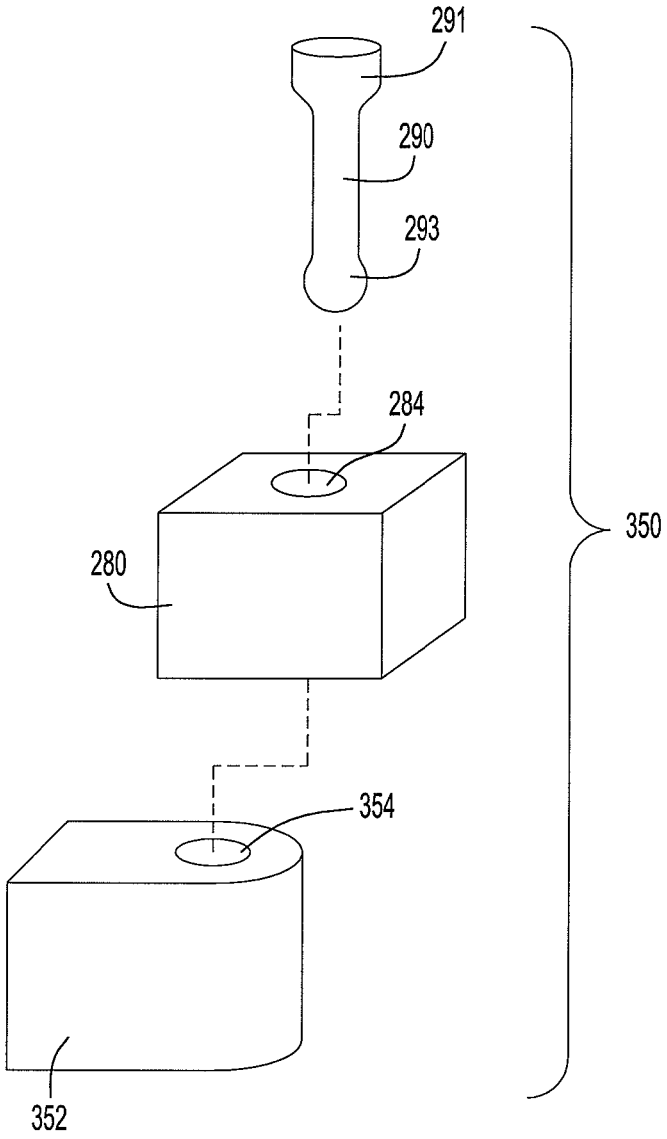
FIG. 16 illustrates an exploded perspective view of some components illustrated in FIG. 15.

Referring to FIG. 16, an exploded view of these components forming a mounting assembly 350 is illustrated. As shown, connector 290 includes an upper end 291 and a lower end 293. In various embodiments, the size and configuration of connector 290 can vary. Lower end 293 may be slightly larger than the main body or shaft of connector 290 so that it can be coupled to coupler 352. Coupler 280 includes a hole 284 extending therethrough and coupler 352 includes a hole 354 that is configured to receive and retain therein the lower end 293 of the connector 290.

Referring back to FIG. 15, the connector 290 is longer than the height of coupler 280 and the extent to which connector 290 extends into hole 354. The hole 284 in coupler 280 is configured so that coupler 280 can slide along connector 290 relative to side 204. Such movement allows the side portion 250 to move up and down. In particular, coupler 280 can be pulled upwardly to move along the direction of arrow "C" and can be moved downwardly along the direction of arrow "D" in FIG. 13 relative to the side 204 of frame 202.

Figure 17:
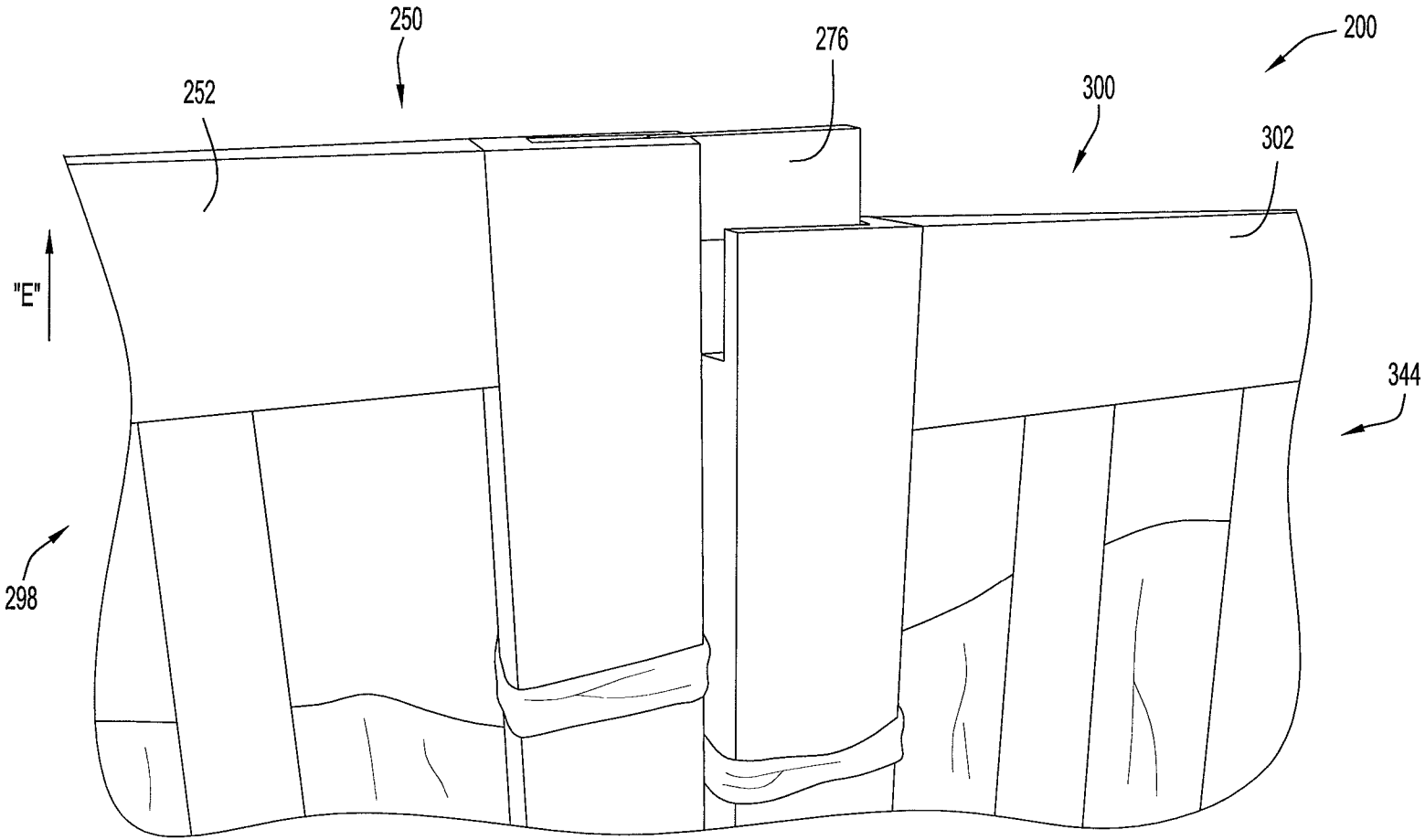
FIG. 17 illustrates a front view of the upper parts of the side portions of the infant support structure illustrated in FIG. 8 in an unlocked configuration.
Figure 18:
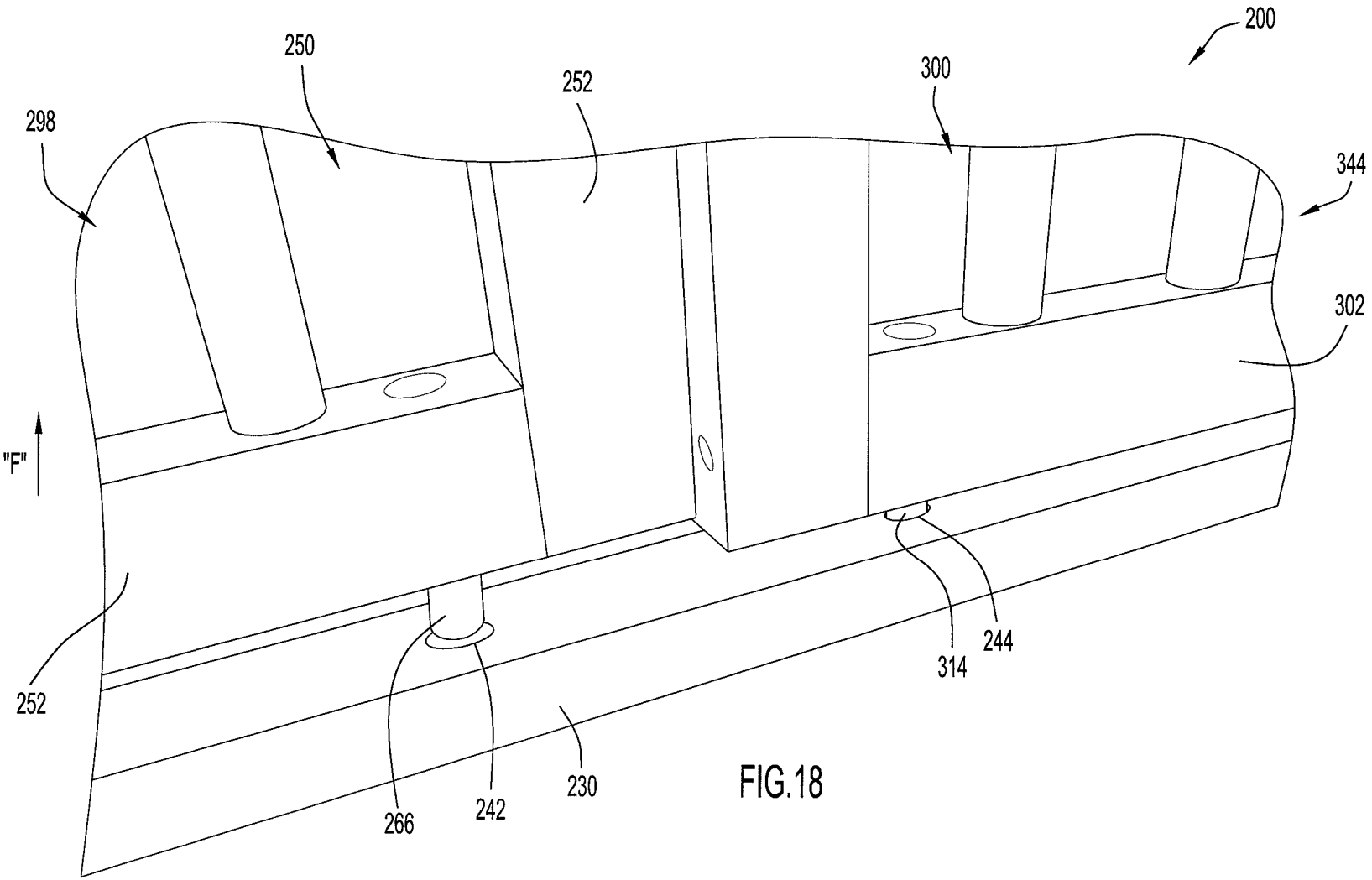
FIG. 18 illustrates a front view of the lower parts of the side portions illustrated in FIG. 17.

Referring to FIGS. 17 and 18, the movement of side portion 250 relative to the frame 202 and side portion 300 is illustrated. As side portion 250 is moved upwardly along the direction of arrow "E" in FIG. 17, the side portion 250 moves to its upper position 298. When the side portion 250 is moved upwardly a sufficient distance, the locking member 276 extending from frame 252 disengages from the slot in the frame 302 of side portion 300. In FIG. 17, side portion 300 is illustrated in its lower position 344. In one variation, the side portions 250 and 300 can be moved upwardly and downwardly substantially simultaneously.

At the same time, projection 266 disengages from the hole 242 formed in locking member 230, as shown in FIG. 18. While not illustrated in FIG. 18, the other projection 264 on the lower surface 262 of the side portion frame 252 also disengages from its corresponding hole when the side portion 250 moves upwardly along the direction of arrow "F" in FIG. 18.

When the locking member 276 and the projections 264 and 266 are disengaged from side portion 300 and latch member 230, respectively, the side portion 250 can be moved about connectors 290 and 292. In particular, the side portion 250 can pivot or rotate about the axis defined by connectors 290 and 292 and move to an open position. The side portion 250 can be moved to an open position while it is in its upper position or in its lower position.

Once the side portion 250 is disengaged from side portion 300, side portion 300 can be moved upwardly along the direction of arrow "F" in FIG. 18, thereby disengaging the projections 312 and 314 from openings 240 and 244 in the latch member 230. Once the projections are disengaged, the side portion 300 can be rotated or moved outwardly to an open position. In different uses of the infant support structure 200, a user may open one or both of the side portions 250 and 300.

To close the side 210 and secure the frame 202 of the infant support structure 200, side portions 250 and 300 are pivoted or rotated toward their closed positions. As side portion 300 approaches the latch member 230, the side portion 300 is lifted upwardly to its upper position and then lowered to its lower position 344 when the projections 312 and 314 are aligned with holes 240 and 244, respectively. Similarly, when the other side portion 250 approaches the latch member 230, side portion 250 is lifted upwardly to its upper position 298 and then lowered to its lower position 297 when the projections 264 and 266 are aligned with holes 238 and 242, respectively, and when locking member 276 is aligned with slot 320 of side portion 300.

Figure 19:
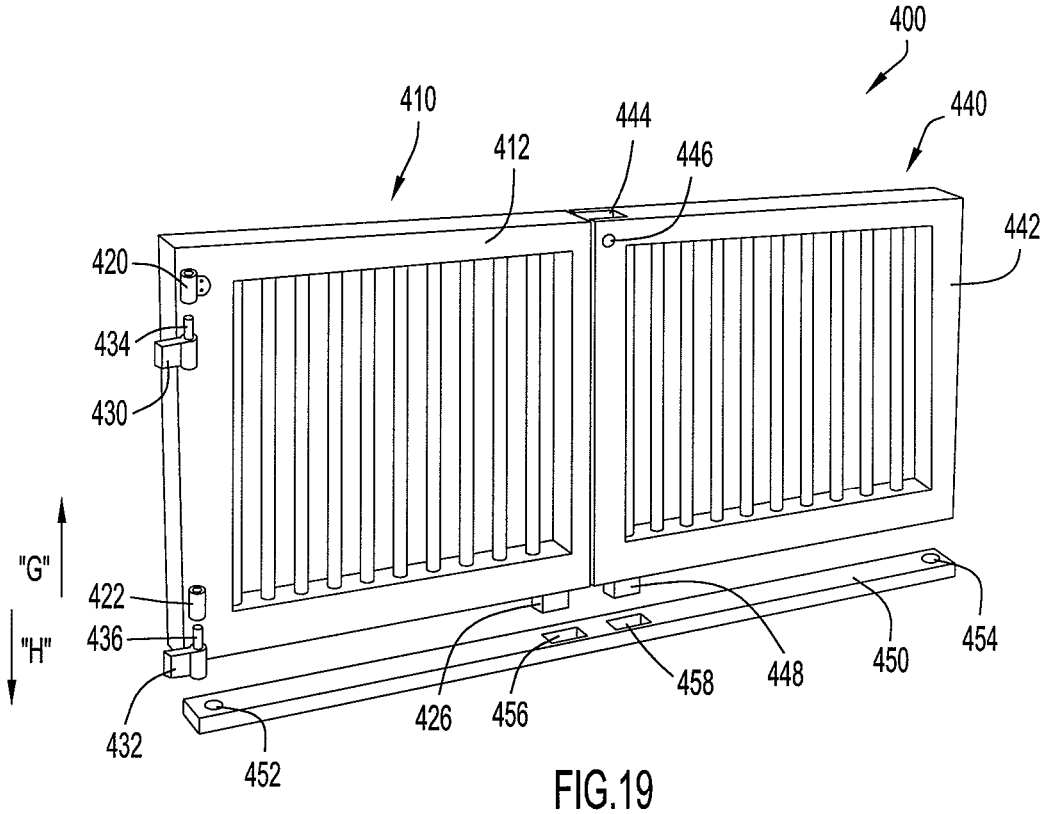
FIG. 19 illustrates a perspective view of the side portions of another embodiment of an infant support structure according to an aspect of the present invention.
Figure 20:
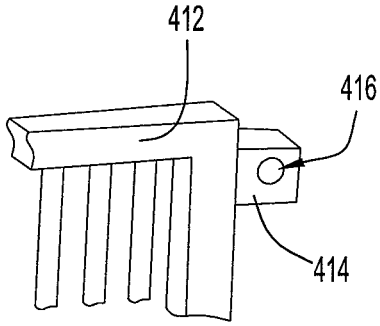
FIG. 20 illustrates a close-up perspective view of part of a side portion illustrated in FIG. 19.

An alternative embodiment of side portions for an infant support structure is illustrated in FIGS. 19 and 20. Infant support structure 400 can include substantially the same structures as infant support structure 200. Infant support structure 400 includes side portions 410 and 440. Side portion 410 includes a frame 412 with one projection 426 extending downwardly from the frame 412. Similarly, side portion 440 includes a frame 442 with one projection 448 extending downwardly from the frame 442.

The infant support structure 400 includes a latch member 450 that is elongate and includes ends 452 and 454. Latch member 450 includes openings or notches 456 and 458 that are configured to receive projections 426 and 448, respectively.

In this embodiment, side portion 410 includes couplers 420 and 422 that are configured to be slid onto and rotated relative to couplers 430 and 432, respectively, which are coupled to a portion of a frame of the infant support structure 400. The couplers 430 and 432 include pins or posts 434 and 436, respectively. The pins 434 and 436 can be referred to as lift pins. The couplers 420 and 422 are configured to allow side portion 410 to move upwardly and downwardly along the direction of arrows "G" and "H", respectively.

In this configuration, the frame 412 of side portion 410 includes a locking member 414 (see FIG. 20) that is configured to engage a slot 444 in side portion 440. The locking member 414 is coupled to frame 412 includes a push button 416 that can be activated to decouple the locking member 414 from the other side portion 440. An actuator or button 446 is provided for a user to activate the push button 416.

In alternative embodiments, the quantity of projections extending from a side portion can vary. In addition, the locations of the projections can vary as well. In different embodiments, any type of material can be used for the components of the frame of the infant support structure. For example, some of the components can be made from wood, metal, molded plastic, or similar materials.

Figure 21:
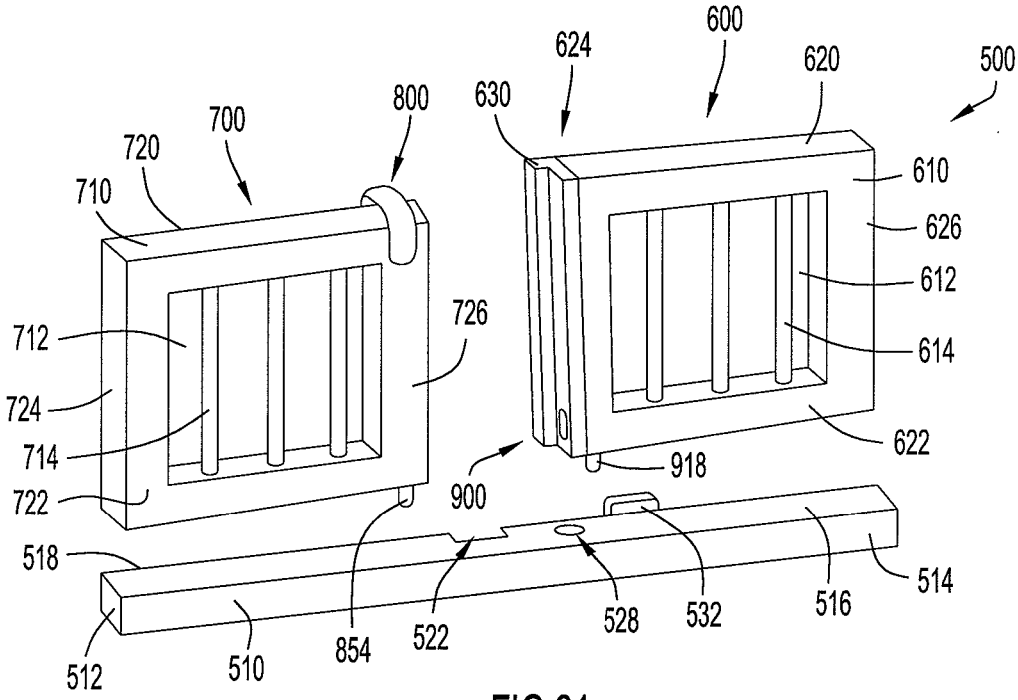
FIG. 21 illustrates another embodiment of an infant support structure according to an aspect of the present invention.

An alternative embodiment of a frame according to an aspect of the invention is illustrated in FIG. 21. In FIG. 21, only a portion of the frame is illustrated for simplicity of the description only. It is to be understood that the frame used with any of the components illustrated in and described relative to FIGS. 21-37 may include sides, legs, a mattress and other features previously described for the frames of infant support structures 10, 100, 200, and 400.

Referring to FIG. 21, a portion of a frame 500 is shown. The frame 500 includes a base 502 (see FIG. 25) that can support a mattress and/or other bedding thereon. The frame 500 also includes an elongate member 510, such as a bar, that extends along a side of the frame 500. The elongate member 510 can be made of wood or other sufficiently strong material for use in the infant support structure. The frame 500 includes side portions or doors 600 and 700 that are pivotally mounted to the frame 500 and can be moved relative thereto to provide access to the interior of the frame 500. Each of the side portions 600 and 700 is mounted proximate to and above the bar 510.

Figure 22:
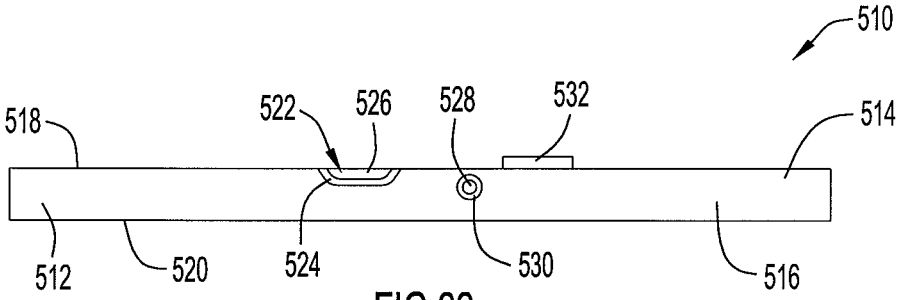
FIG. 22 illustrates a top view of the bar of the infant support structure illustrated in FIG. 21.

As shown in FIGS. 21 and 22, the bar 510 has opposite ends 512 and 514 and an upper surface 516 that extends along the length of the bar 510. The bar 510 has an inner surface 518 that is oriented on the inner side of the frame 500 and an opposite, outer surface 520 that is oriented on the outer side of the frame 500. In this embodiment, the bar 510 includes several features that are configured to be engaged by one of the side portions 600 and 700.

Figure 23:
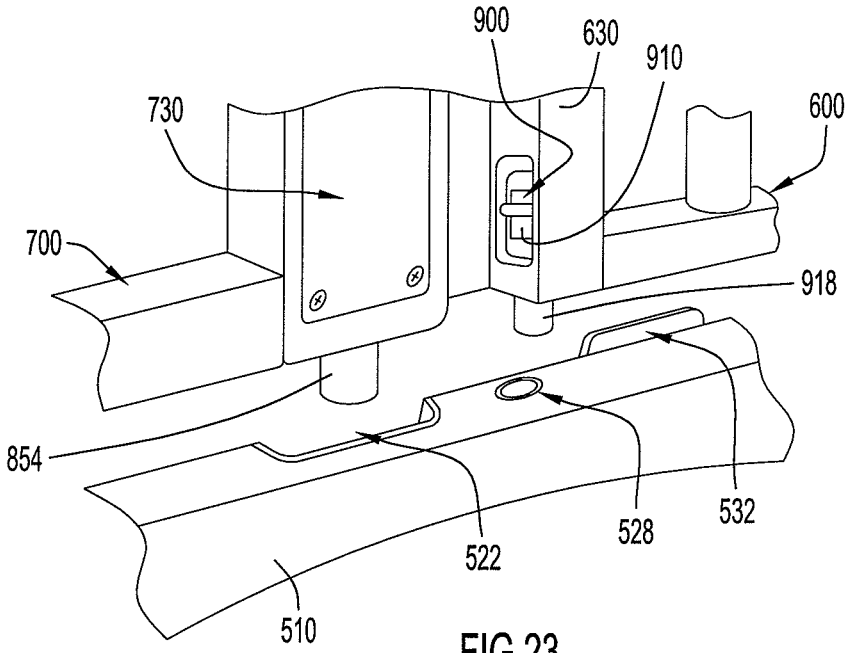
FIG. 23 illustrates an exploded partial perspective view of the side portions and bar of the infant support structure illustrated in FIG. 21.

As shown in FIGS. 21-23, the bar 510 includes a notch or recess 522 that is open to the inner surface 518. The notch 522 is defined in one part by a lower surface 526. In this embodiment, the edge defining the notch 522 includes a chamfer 524 which can facilitate the lead-in to the notch 522. The bar 510 also includes an opening or recess 528 that is formed in its upper surface 516. The edge defining the opening 528 can include a chamfer 524 as well.

In this embodiment, the bar 510 includes a plate 532 that is coupled to the inner surface 518. The plate 532 is positioned so that a portion of the plate 532 extends above the top surface 516. The plate 532 functions as a stop that limits the movement of side portion 600 inwardly relative to the bar 510. The plate 532 can be made of metal and attached to the bar 510 using conventional fasteners.

As shown in FIG. 21, side portion 600 includes a body 610 that defines an opening 612 in which several bars 614 are disposed. The body 610 includes an upper end 620, a lower end 622, and sides 624 and 626. Proximate to side 624 is an engagement member or portion 630, the function of which is described in detail below. Similarly, side portion 700 includes a body 710 that defines an opening 712 in which several bars 714 are disposed. The body 710 includes an upper end 720, a lower end 722, and sides 724 and 726. Proximate to side 724 is an engagement member or portion 730 (see FIG. 23). In different embodiments, the shape and configuration of the side portions 600 and 700 can vary as well as the quantity of bars 612 and 714.

The side portions 600 and 700 are configured to engage each other and be locked in their closed positions by a latch or locking mechanism 800 and a latch or locking mechanism 900. In this embodiment, the latch mechanism 900 performs a locking function by securing side portion 600 in its closed or locked position. The locking mechanism 800 performs two locking functions in this embodiment. First, the locking mechanism 800 is used to secure side portion 700 in its closed or locked position. Second, the locking mechanism 800 is used to secure side portion 700 to side portion 600. Both locking functions of locking mechanism 800 occur simultaneously.

As shown in FIGS. 21 and 23, side portion 700 includes a locking mechanism 800 that can be manipulated by a user. The locking mechanism 800 includes a post or extension 854 that is movable relative to the body 710 and that extends below the lower surface of the body 710. When the extension 854 extends in its position shown in FIGS. 21 and 23, the extension 854 can engage the recess 522 in the bar 510. As discussed below, the locking mechanism 800 is configured to engage side portion 600 as well.

Referring to FIGS. 21 and 23, side portion 600 includes a latch mechanism 900 that is used to prevent movement of the side portion 600 relative to the bar 510. The latch mechanism 900 can be manipulated by a user to prevent movement of the side portion 600 relative to the frame 500 and bar 510. The latch mechanism 900 includes a body 910 (see FIG. 24) and an extension 918 coupled thereto. The body 910 and the extension 918 are movable so that the position of the extension 918 relative to the lower surface 628 of the side portion 600 can be adjusted. When the extension 918 extends beyond the lower surface 628, the extension 918 can engage the opening 528 in the bar 510 to restrict the movement of the side portion 600.

Figure 24:
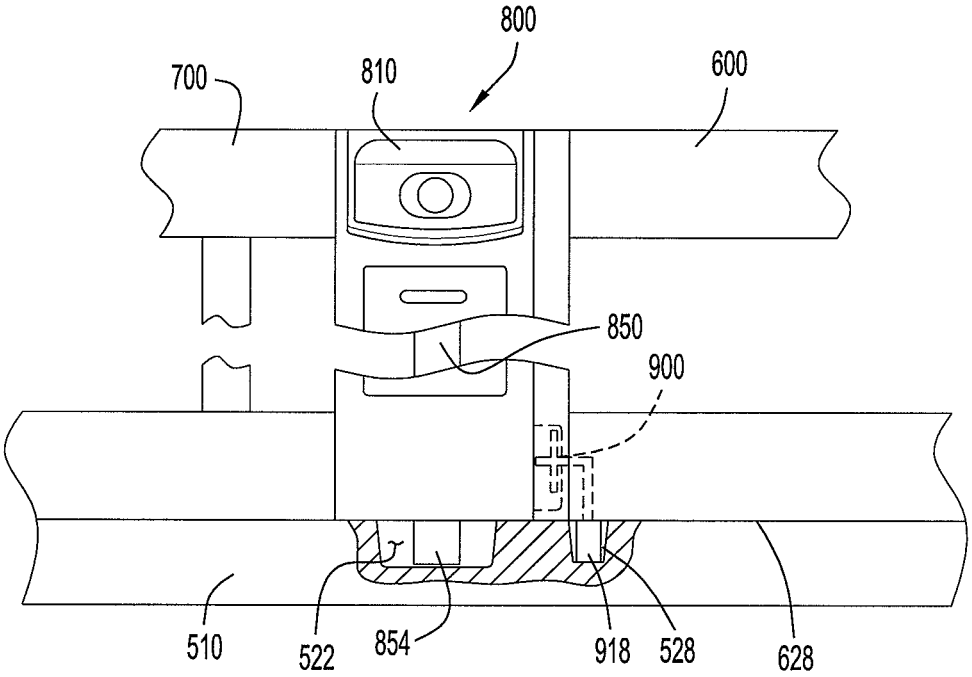
FIG. 24 illustrates a partial front view of the side portions and bar illustrated in FIG. 21.

Referring to FIG. 24, an exemplary embodiment of locking the side portions 600 and 700 is illustrated. As shown, the locking mechanism 800 includes an actuator 810 with a rod 850 having an end or extension 854. The extension 854 is illustrated as engaging the recess 522. The latch mechanism 900 includes a body 910 that is coupled to end or extension 918. In this implementation, the extension 918 is illustrated as engaging the opening 526.

Figure 25:
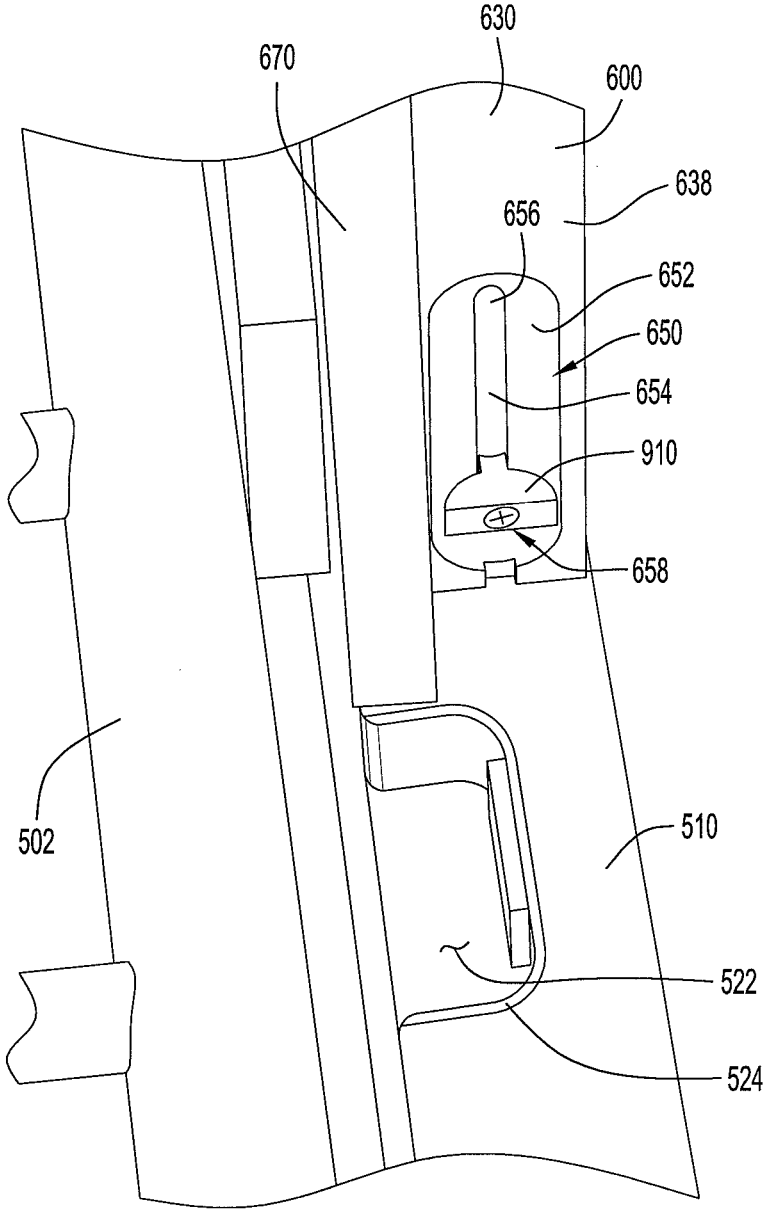
FIG. 25 illustrates a close-up view of part of a side portion and the bar of the infant support structure illustrated in FIG. 21.
Figure 26:
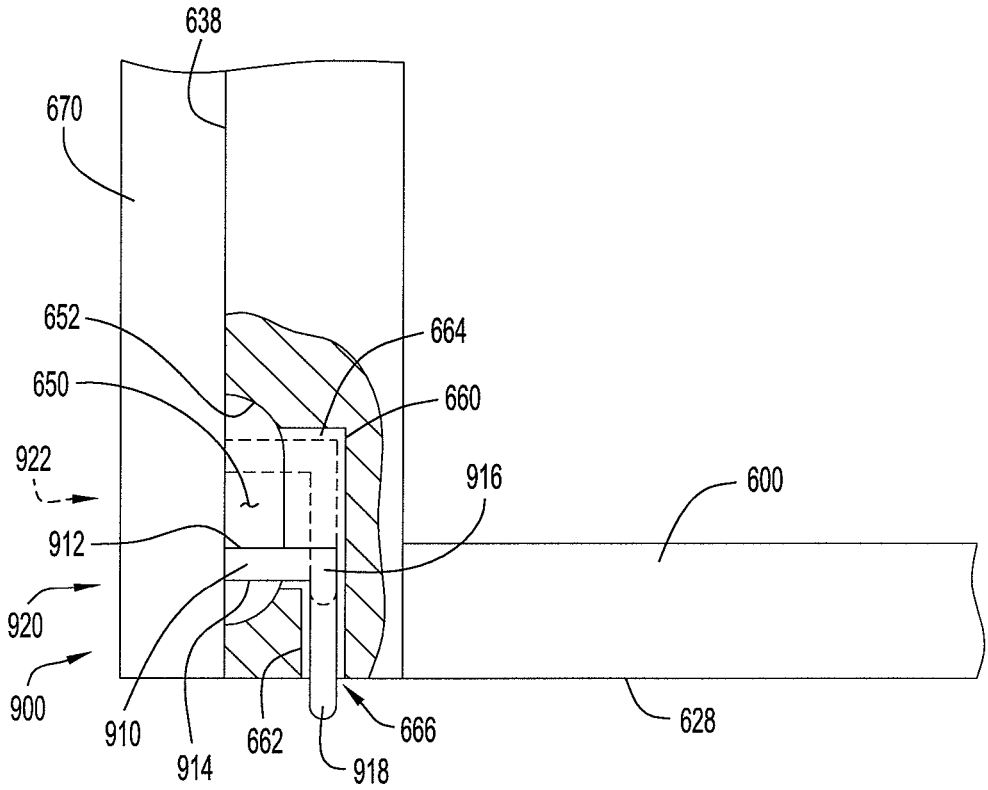
FIG. 26 illustrates a partial cross-sectional side view of the latch mechanism and a side portion of the infant support structure illustrated in FIG. 21.
Figure 27:
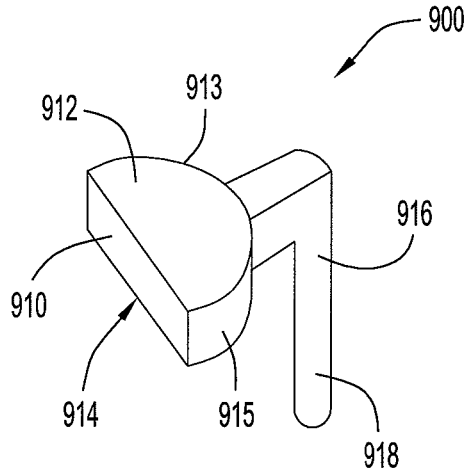
FIG. 27 illustrates a perspective view of the latch mechanism illustrated in FIG. 26.

Referring to FIGS. 25-27, an embodiment of a latch mechanism and a side portion according to an aspect of the present invention is illustrated. Referring to FIG. 25, side portion 600 is illustrated relative to the base 502 of the frame 500 and bar 510. The recess 522 in the bar 510 with chamfer 524 is illustrated. In other embodiments, the recess 522 and opening 526 can be formed without a chamfer 524. Side portion 600 includes an engaging portion or member 630 and an extension 670. The engaging portion 630 includes an engaging surface 638 with a recess 650 defined by a surface 652 that is generally elongate with curved areas. A slot 654 is formed in the surface 652 and extends from an end 656 to an end 658. The slot 654 is in communication with a chamber or channel 664 that is defined by walls 660 and 662 (see FIG. 26) in the engaging portion 630. An opening 666 is formed at the lower end of the chamber 664 in the lower surface 628 of side portion 600.

Referring to FIG. 27, an embodiment of a latch mechanism is illustrated. In this embodiment, the latch mechanism 900 includes a body 910 with two surfaces 912 and 914 that can be engaged by a user to move the body 910. The body 910 also includes curved surfaces 913 and 915 that are configured to cooperate with the curved portions of the surface 652 defining the recess 650. Coupled to the body 910 is a link 916 that has an end or extension 918. In one embodiment, the link 916 can be formed separately from the body 910 and coupled thereto using a fastener or other coupling device. In an alternative embodiment, the link 916 can be integrally formed with the body 910. The latch mechanism 900 can be made of molded plastic, metal, or another material that has sufficient strength.

Referring to FIG. 26, movement of the latch mechanism 900 is illustrated. The latch mechanism 900 is illustrated in a locked position 920 in which the extension 918 extends through opening 666 and the corresponding opening in the bar 510. To move the latch mechanism 900 from the locked position 920 to an unlocked position 922 (shown in FIG. 26 in dashed lines), a user can engage the lower surface 914 and move the body 910 upwardly. In the unlocked position 922, the extension 918 is disengaged from the bar 510. To move the latch mechanism 900 back to the locked position 920, a user can engage the upper surface 912 and move the body 910 downwardly.

Figure 28:
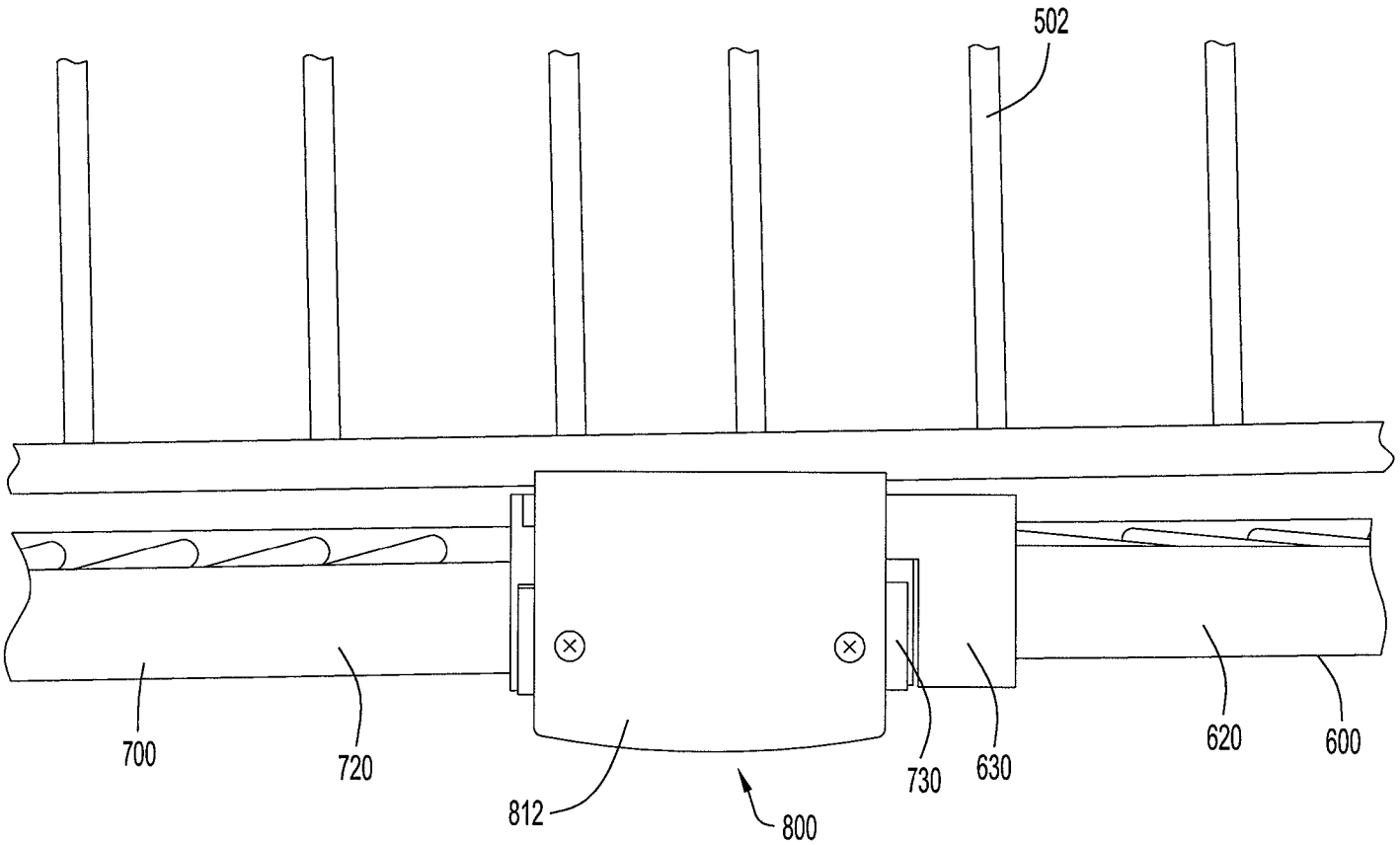
FIG. 28 illustrates a top view of the side portions of the infant support structure illustrated in FIG. 21 illustrated in a closed configuration.

Referring to FIG. 28, a top view of the side portions 600 and 700 in their closed positions is illustrated. In their closed positions, the side portions 600 and 700 are substantially parallel to bar 510 and proximate to the base 502. As previously discussed, side portion 600 includes an upper end 620 and an engaging member 630 and side portion 700 includes an upper end 720 and an engaging member 730. The body 812 of the latch mechanism 800 is also illustrated.

Figure 29:
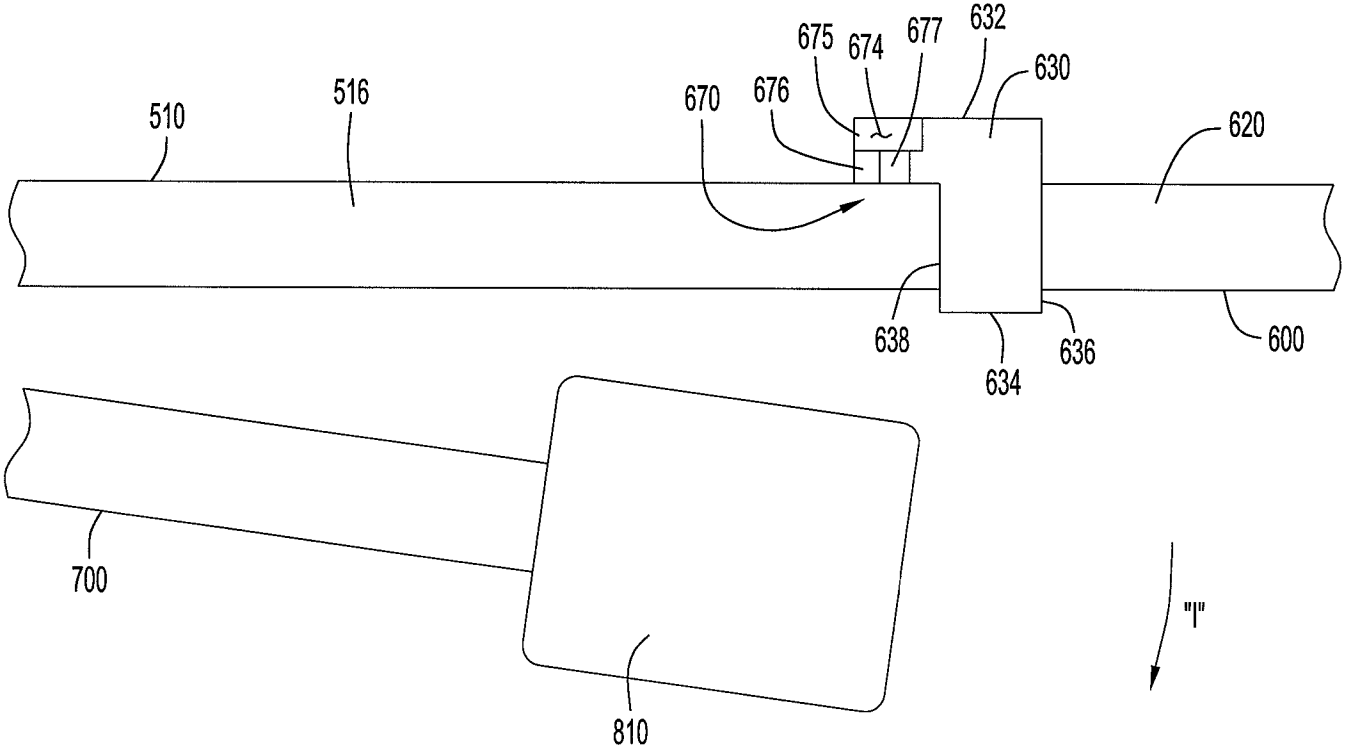
FIG. 29 illustrates a top view of the side portions of the infant support structure illustrated in FIG. 28 illustrated in an opened configuration.

Referring to FIG. 29, side portion 700 is illustrated in an opened position relative to the frame 500 and side portion 600. The actuator 810 of the locking mechanism 800 is coupled to the side portion 700 and moves therewith. Side portion 700 has been moved away from the bar 510 along the direction of arrow "I" in FIG. 29. A top view of the engaging member 630 of side portion 600 is also shown in FIG. 29.

Figure 30:
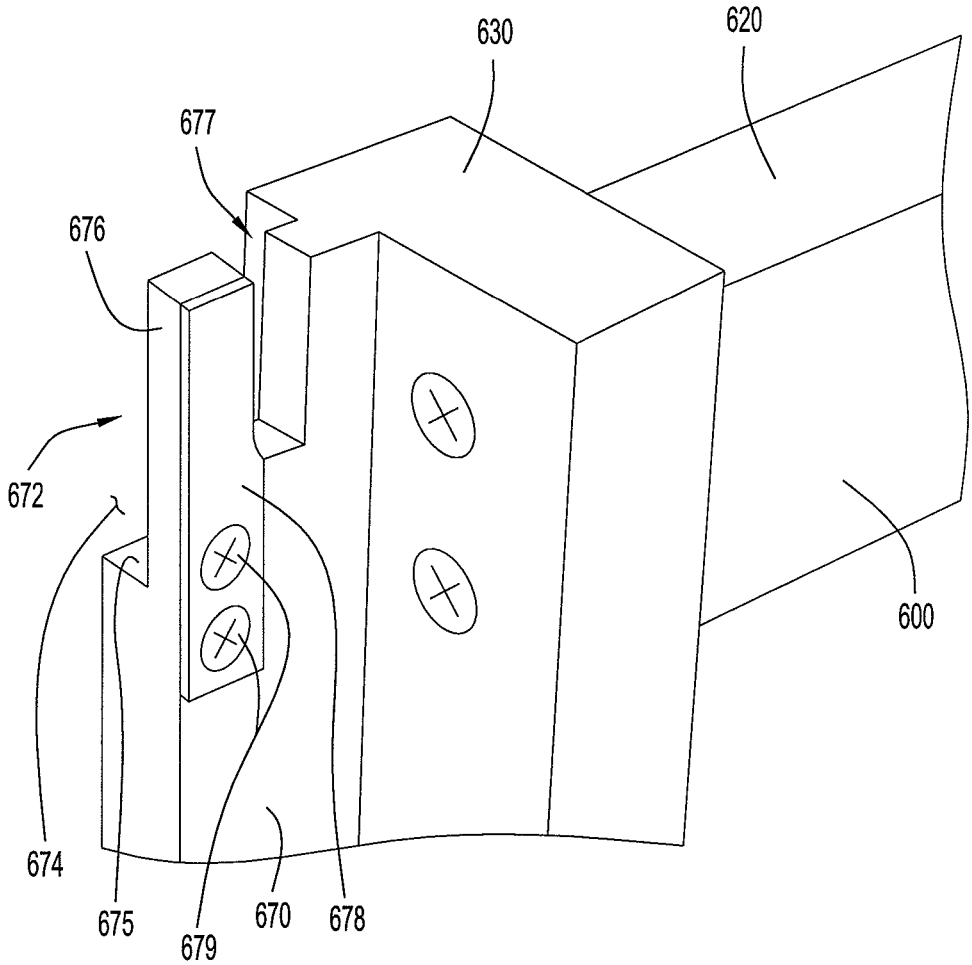
FIG. 30 illustrates a perspective view of a part of a side portion of the infant support structure illustrated in FIG. 21.

Referring to FIGS. 29 and 30, the engaging member 630 includes an inner surface 632, an opposite, outer surface 634, a mounting surface 636 that can be coupled to components of the side portion 600, and the engaging surface 638. The extension 670 has an upper end 672 proximate to which a notch 674 is formed by a surface 675 and a projection 676 is formed that defines a slot 677. In one embodiment, a reinforcing member 678, such as a piece of metal, can be coupled to the projection 676 by fasteners 679. In one embodiment, the components of the side portions 600 and 700 can be made of wood. In other embodiments, the components of the side portions 600 and 700 can be formed of a molded material, such as plastic, or metal.

Figure 31:
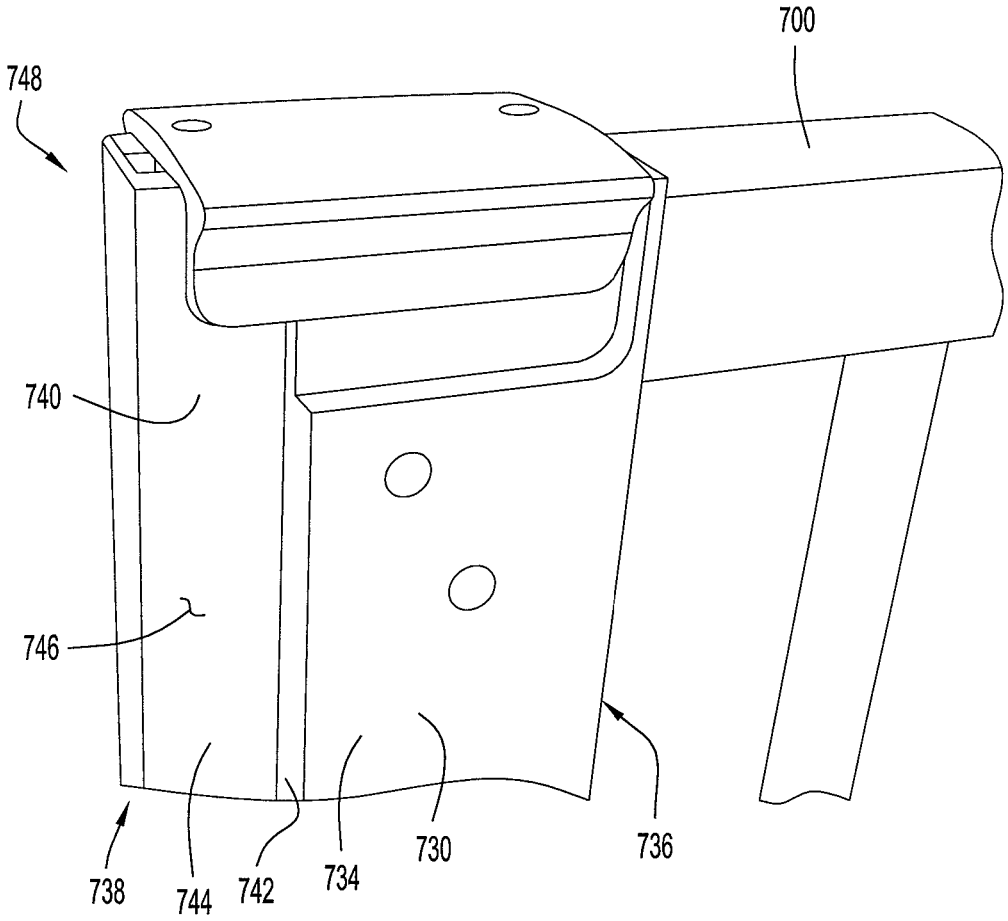
FIG. 31 illustrates a rear view of part of a side portion of the infant support structure illustrated in FIG. 21.

Referring to FIG. 31, a view of the inner side and upper end 748 of side portion 700 is illustrated. In this embodiment, the side portion 700 includes an engaging member 730 that has an inner portion 734 that is on the inside of the side portion 700. The engaging portion 730 includes a mounting portion 736 that can be coupled to other components of the side portion 700 using fasteners. The engaging portion 730 includes an engaging portion 738 and a shoulder 740 that includes a surface 744. Surface 744 and surface 742 collectively form a notch 746 that is configured to receive the extension 670 of side portion 600 when the side portions 600 and 700 are in their closed positions.

Figure 32:
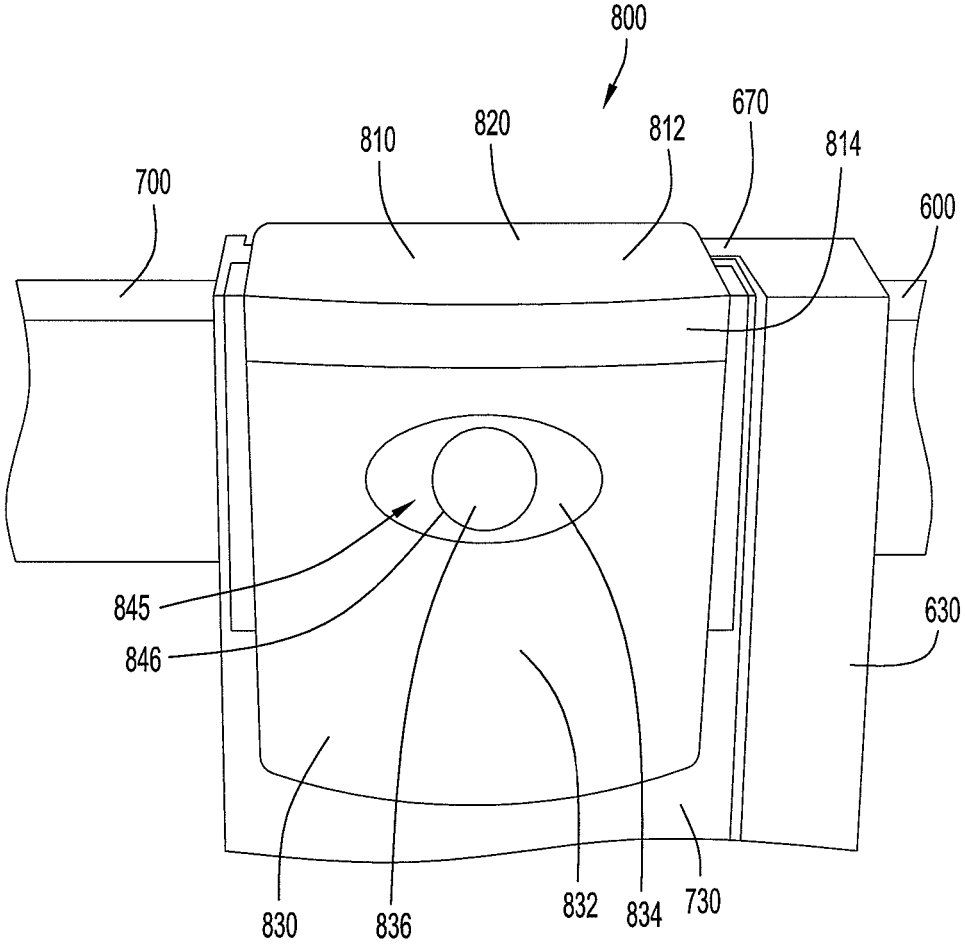
FIG. 32 illustrates a front view of the locking mechanism of the infant support structure illustrated in FIG. 21.

Referring to FIGS. 32-35, the structure and operation of the locking mechanism 800 is illustrated. As shown in FIG. 32, the locking mechanism 800 includes an actuator 810 that includes a body or handle 812 with a gripping portion 814 that can be grasped by a user (see FIGS. 33-35). The gripping portion 814 includes ridges 816 and 818 that facilitate the gripping of the actuator 810. In one embodiment, the body 812 includes an upper surface 820 on which a label or indicia can be disposed.

The actuator 810 includes a front portion 830 with a front surface 832 that has a recessed area 834 and an opening 836 formed therein. A release mechanism 845 including a spring-mounted button 846 is provided with the actuator 810. The button 846 is movably mounted in the opening 836 and can be pressed inwardly by a user against the force of a spring (not shown) to release the actuator 810 for movement.

Figure 33:
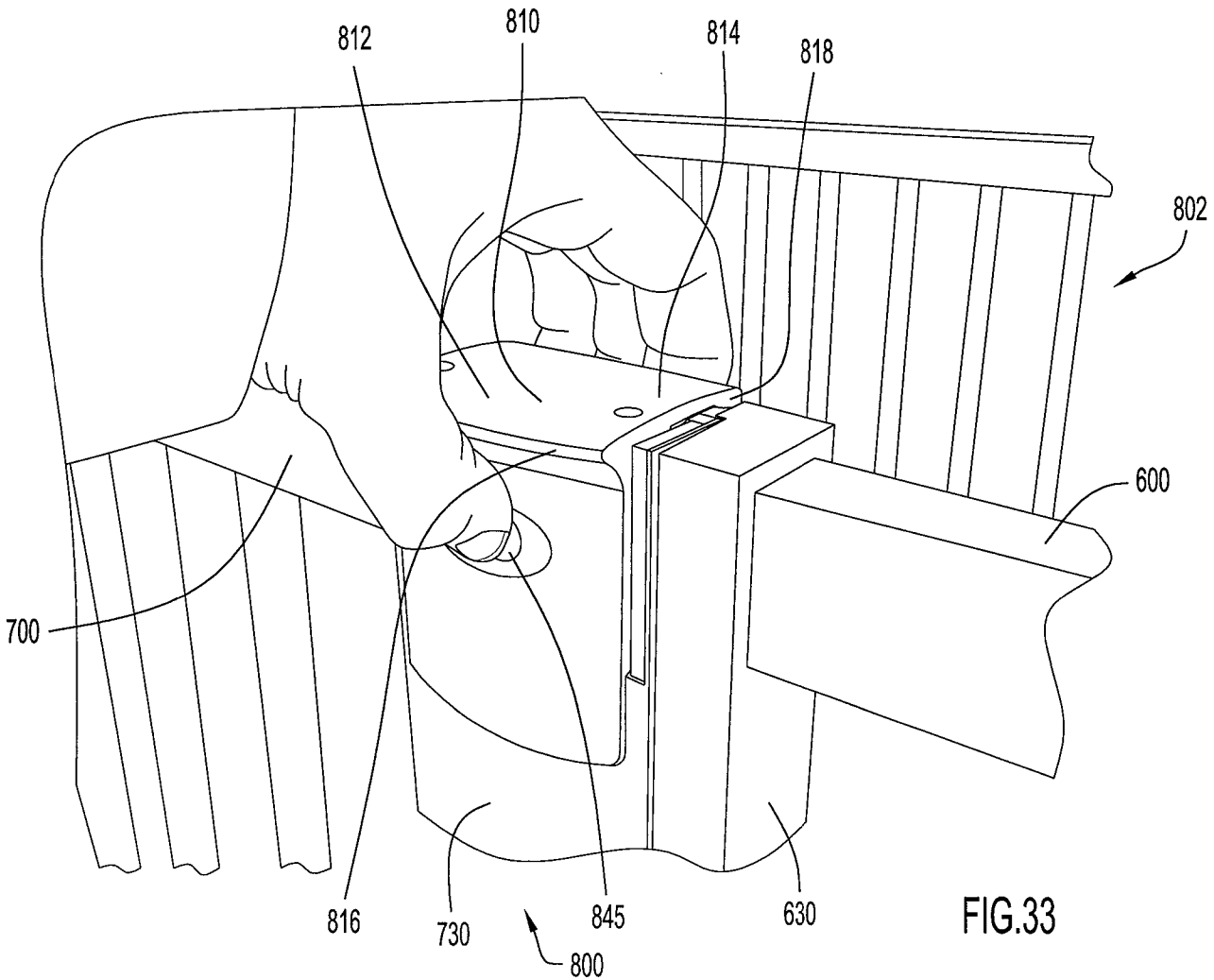
FIG. 33 illustrates a perspective view of the locking mechanism illustrated in FIG. 32 in a locked position.
Figure 34:
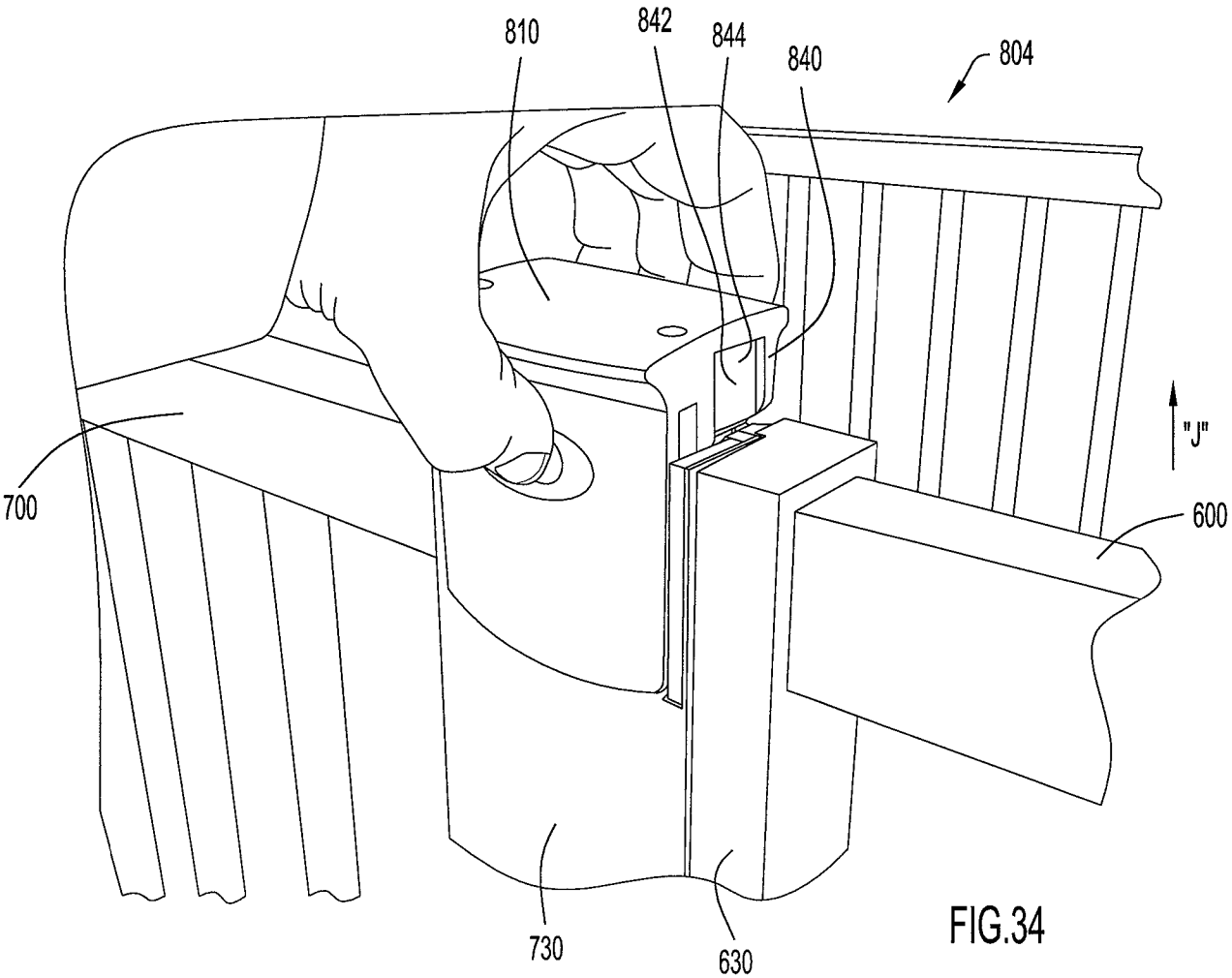
FIG. 34 illustrates a perspective view of the locking mechanism illustrated in FIG. 32 in an unlocked position.
Figure 35:
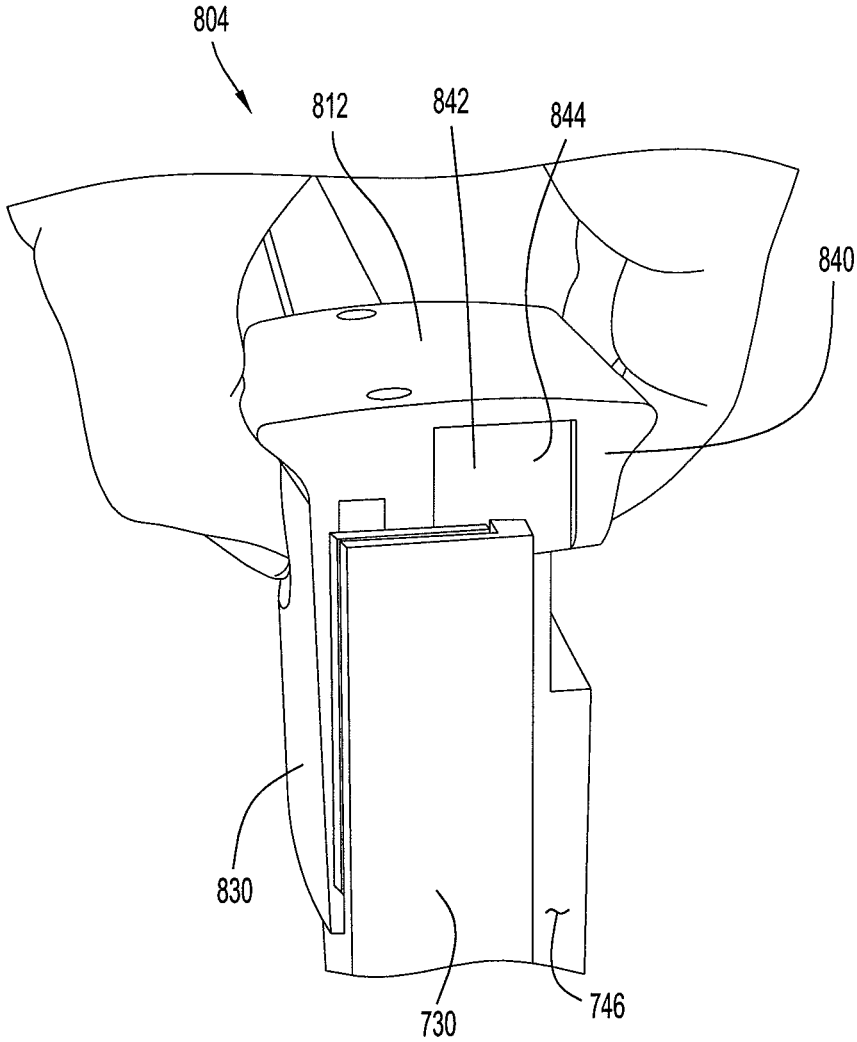
FIG. 35 illustrates an end view of the locking mechanism and corresponding side portion illustrated in FIG. 34.

Referring to FIG. 33, the locking mechanism 800 is illustrated in a locked position 802. A user can press inwardly on the release mechanism 845 and lift the actuator 810 upwardly along the direction of arrow "J" in FIG. 34. When lifted upwardly, the actuator 810 is disposable or positionable in an unlocked or upper position 804. In this position, the extension 854 that engages the recess 522 in the bar 510 is disengaged from the recess 522. As shown in FIGS. 33 and 34, the body 812 of the actuator 810 includes a rear portion 840 that defines a channel 842 in which a side portion or member 844 is disposed. When the actuator 810 is moved to its lower or locked position 802, the side portion 844 slides into the slot 677 in the extension 670 and the rear portion 830 engages the notch 674 (which is illustrated in FIG. 29). As a result, the projection 676 is captured by the rear portion 830 and side portion 844 of the actuator 810, thereby locking side portion 700 to side portion 600. When the actuator 810 is moved to its upper or unlocked position 804, the rear portion 830 and side portion 844 are moved higher than the upper end of the projection 676, thereby allowing the side portion 700 and actuator 810 to be moved relative to the frame 500 to open the side of the frame 500.

Figure 36:
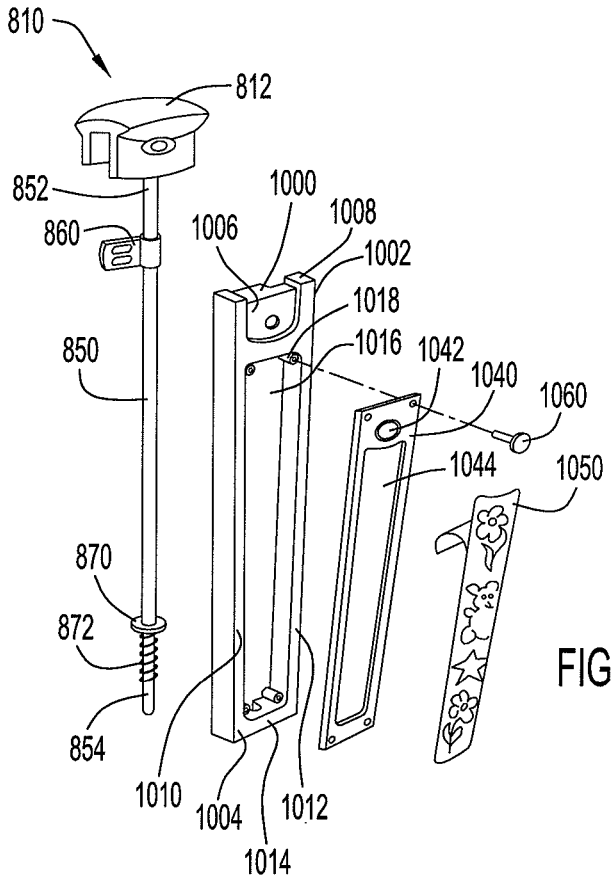
FIG. 36 illustrates an exploded perspective view of an embodiment of some of the components of a locking mechanism according to an aspect of the invention.
Figure 37:
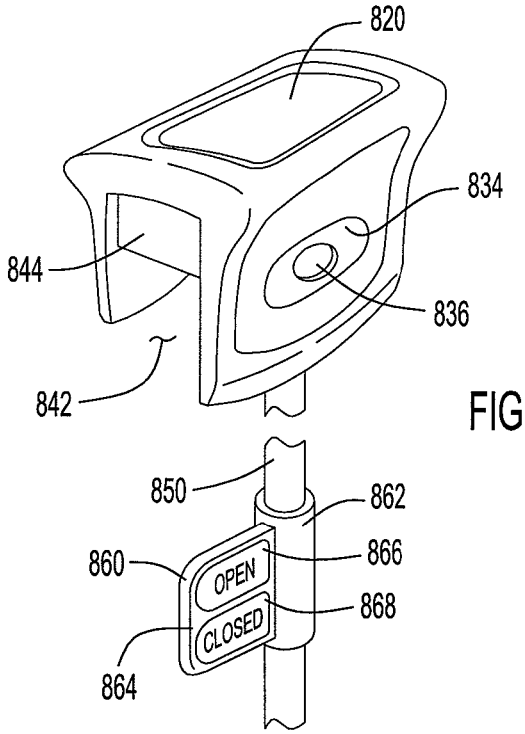
FIG. 37 illustrates a perspective view of a portion of the actuator and rod of the locking mechanism illustrated in FIG. 36.

Referring to FIGS. 36 and 37, an embodiment of a locking mechanism according to an aspect of the invention is illustrated. As shown in FIG. 36, the actuator 810 includes a body 812 with a rod 850 coupled thereto. In this implementation, the rod 850 is substantially cylindrical and has an upper end 852 and a lower end 854. Disposed on the rod 850 is a marker 860 that includes a sleeve 862 (see FIG. 37) that is coupled to a plate 864. The marker 860 can include indicia indicating whether the locking mechanism is locked or unlocked. For example, indicia 866 indicating "OPEN" and indicia 868 indicating "CLOSED" can be disposed on the plate 864. The indicia is used to visually show a user when the side portions or gates 600 and 700 are locked. In this embodiment, the sleeve 862 is fixed in place relative to the rod 850. Also coupled to the rod 850 is a stopper 870. A spring 872 is mounted on the rod 850 and engageable with the stopper 870. The spring 872 is configured to bias the rod 850 and actuator 810 into an unlocked position.

Referring to FIG. 36, the locking mechanism 800 may include a housing 1000 that has an upper end 1002 and a lower end 1004. Proximate to the upper end 1002 is a recessed area 1006 that is defined by edge 1008. The front portion 830 of the actuator 810 is slidably received in the recessed area 1006. As a result, the front portion 830 is able to sit flush with the front surface of the housing 1000. The housing 1000 also includes several walls 1010, 1012, and 1014 that collectively define a cavity or interior region 1016 through which the rod 850 and related mechanism can be disposed and extend. The housing 1000 can also include several mounting shoulders 1018, each of which has an opening to receive a fastener.

A cover plate 1040 can be disposed to cover the cavity 1016 of the housing 1000. The cover plate 1040 can include an opening 1042 through which a corresponding one of the indicia 866 and 868 on marker 860 can be viewed. In one embodiment, the cover plate 1040 can include a recessed area 1044 that is configured to receive a label or sticker 1050. In other embodiments, the cover plate 1040 does not include a recessed area 1044.

In different embodiments, the frame including the side portions may be made of wood, molded plastic, metal, or other materials with sufficient strength, or a combination of different types of materials.

The foregoing embodiments are configured to be manipulated by a user using either one hand or two hands. There are several configurations in which an infant support structure can be disposed. In one configuration, the gates or side portions can both be closed and locked. In another configuration, one of the side portions can be opened and the other side portion can remain closed. In another configuration, both of the side portions can be opened. When one or both of the side portions is opened, the opening that is formed facilitates the removal of a mattress. In addition, a parent or caregiver can sit in the opening along side an infant in the infant receiving area and soothe the infant.

While the invention has been described in detail and with reference to specific embodiments thereof, it will be apparent to one skilled in the art that various changes and modifications can be made therein without departing from the spirit and scope thereof. For example, it is to be understood that terms such as "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. A frame for an infant support structure comprising:

a first side;

a second side;

a third side; and a fourth side, the first side, the second side, the third side, and the fourth side collectively defining an infant receiving region therebetween, the fourth side including:

a first side portion, the first side portion being movably mounted to a portion of the frame, the first side portion being selectively disposable in a closed position and in an open position, the first side portion being movable upwardly relative to the frame along a first direction and then being movable outwardly along a second direction to its open position; and a second side portion, the second side portion being movably mounted to another portion of the frame, the second side portion being selectively disposable in a closed position and in an open position, the second side portion being movable upwardly relative to the frame along the first direction and then being movable outwardly along a third direction to its open position.

2. The frame of claim 1, wherein the movement of the first side portion upwardly unlocks the first side portion from its closed position.

3. The frame of claim 2, wherein movement of the first side portion along the first direction is substantially linear and movement of the second side portion along the second direction is a pivoting movement.

4. The frame of claim 1, wherein the frame includes a latch member that extends along the fourth side, the first side portion engages the latch member when the first side portion is in its closed position, and the second side portion engages the latch member when the second side portion is in its closed position.

5. The frame of claim 4, wherein the latch member defines a first recess and a second recess, the first side portion includes a first projection, and the second side portion includes a second projection, the first side portion being locked in its closed position when the first projection engages the first recess, and the second side portion being locked in its closed position when the second projection engages the second recess.

6. The frame of claim 5, wherein movement of the first side portion upwardly causes the first projection to disengage from the first recess, and movement of the second side portion upwardly causes the second projection to disengage from the second recess.

7. The frame of claim 1, wherein the first side portion is pivotally mounted to the frame, and the second side portion is pivotally mounted to the frame.

8. The frame of claim 1, wherein the first side portion has a first locking portion, the second side portion has a second locking portion, and the first locking portion is configured to engage the second locking portion to lock the first side portion to the second side portion.

9. The frame of claim 8, wherein the first locking portion includes a recess and the second locking portion includes an extension, the recess being configured to receive the extension to couple the first side portion to the second side portion.

10. The frame of claim 8, wherein movement of the first side portion upwardly relative to the second side portion results in the first locking portion disengaging from the second locking portion.

* * * * *